US005296876A

United States Patent [19]

Yamaguchi et al.

[11] Patent Number: 5,296,876

[45] Date of Patent: Mar. 22, 1994

[54] APPARATUS FOR DECLOGGING AN INK JET RECORDING APPARATUS

[75] Inventors: Shuichi Yamaguchi; Seiji Mochizuki; Hideaki Suzuki; Satoshi Shinada; Mayumi Aida, all of Nagano, Japan

[73] Assignee: Seiko Epson Corporation, Tokyo, Japan

[21] Appl. No.: 913,636

[22] Filed: Aug. 18, 1992

Related U.S. Application Data

[62] Division of Ser. No. 608,858, Nov. 5, 1990, Pat. No. 5,153,614.

[30] Foreign Application Priority Data

Nov. 21, 1989 [JP] Japan ..... 1-302853
May 29, 1990 [JP] Japan ..... 2-138980
Nov. 6, 1990 [JP] Japan ..... 1-288390

[51] Int. Cl.[5] ..... B41J 2/165
[52] U.S. Cl. ..... 346/140 R
[58] Field of Search ..... 346/140 R; B41J 2/165, B41J 3/04

[56] References Cited

U.S. PATENT DOCUMENTS 4,362,572 12/1982 Wallace ..... 134/18
4,577,203 3/1986 Kawamura ..... 346/140 R
4,692,777 9/1987 Hasumi ..... 346/140 R
4,926,196 5/1990 Mizoguchi et al. ..... 346/140 R
4,977,459 12/1990 Ebinuma et al. ..... 346/140 R X

FOREIGN PATENT DOCUMENTS 3611333 10/1986 Fed. Rep. of Germany ... B41J 3/04
63-115755 5/1988 Japan ..... B41J 3/04

*Primary Examiner*—Benjamin R. Fuller
*Assistant Examiner*—Alrick Bobb
*Attorney, Agent, or Firm*—Sughrue, Mion, Zinn, Macpeak & Seas

[57] ABSTRACT

In a recording apparatus with an ink jet print head which forms dots on a recording sheet by ink jets shot from an array of nozzles, a microcomputer determines whether a printing defect is a light printing defect caused by paper particles and dust adhering to the nozzles or a heavy printing defect caused by the entry of air bubbles into the ink flow paths. The determination is made on the basis of intervals of operating a print recovery button mounted on a chassis of the recording apparatus. For the light printing defect, the computer puts a cap member to the front face of the nozzles of the print head and applies a negative pressure to the nozzles, thereby to reduce the amount of ink emitted from the nozzles. For the heavy printing defect, the computer increases the amount of ink.

4 Claims, 28 Drawing Sheets

APPARATUS FOR DECLOGGING AN INK JET RECORDING APPARATUS

This is a divisional of application Ser. No. 07/608,858 filed Nov. 5, 1990 now U.S. Pat. No. 5,153,614.

BACKGROUND OF THE INVENTION

The present invention relates to an ink jet recording apparatus in which a linear array of small nozzles and pressure generators communicating with respective ones of those nozzles are provided, and dots are formed on a recording sheet in such a manner that the pressure generators pressure feed ink to the nozzles, and in turn the nozzles shoot ink jets onto the recording sheet. More particularly, the present invention relates to a technique for removing light printing defects due to paper particles, dust, and like, and heavy printing defects due to mixing of air bubbles into the ink jets.

In an ink jet recording apparatus, a linear array of small nozzles, each about 100 μm in diameter, is formed on the top of the print head. To effect printing with this apparatus, the print head is moved over the surface of a recording sheet by a carriage. However, during the printing process, paper particles from the recording sheet and dust stuck to the same tend to adhere to the nozzle openings. The nozzles thus tend to get clogged with the paper particles and dust. This leads to printing defect. Also, air bubble sometimes enter into a connecting portion between the ink tank and the nozzles. In an extreme case, the supply of ink to the nozzles is halted, resulting in no print.

To cope with the problems mentioned above, an ink sucking device in which a negative pressure generating unit, which applies a negative pressure to a cap member for hermetically sealing the nozzle openings of the print head, is installed in the printer. When a printing defect occurs, the user pushes a print recovery button on a control panel. Then, the negative pressure generating unit is driven to produce a negative pressure within the space of the cap member, and hence to forcibly expel a larger amount of ink from the nozzles than in normal printing. With the sucking of the ink, paper particles and dust adhering to the nozzle openings are washed away with the ink jets. In this way, the printer is recovered from the clogging of the nozzles.

Air bubbles are normally present outside from the nozzle openings. The ink thus must be sucked up in such an amount as to extract the air bubble from the nozzle openings. Accordingly, to eliminate air bubbles, the amount of the sucked ink is much larger than that for removing paper particles and dust.

Thus, the forcible discharge of the ink consumes a great amount of ink, which is much larger than that in normal printing. To avoid idle consumption of excessive amounts of ink during maintenance, the usual practice is to limit the amount of ink discharged for each operation of the recovery switch to a preset value. The amount of ink discharged during one suction operation is set at such an amount as to remove the clogging of the nozzles that frequently occurs due to accumulation of paper particles and dust thereon. This amount is 0.5 cc, for example. Therefore, if a user mistakenly pushes the recovery button, the amount of ink consumed is about 0.55 cc at most.

In case where about 2 cc of ink must be discharged, for example, to remove air bubble is removed, the recovery button must be pushed many times. This work is cumbersome for the user. The number of button pushings can be reduced by increasing the amount of ink discharged by one suction operation to such an extent as to remove the bubbles. Where the technique is employed, the ink is excessively discharged or sucked for curing light printing defects caused by paper particles and dust stuck to the nozzles, which frequently occurs.

SUMMARY OF THE INVENTION

Accordingly, an object of the present invention is to provide an ink jet recording apparatus with a printing defect recovery function which limits the amount of ink required for curing light printing defects, and to reduce the number of ink sucking operations for removing air bubbles.

Another object of the present invention is to provide an ink jet recording apparatus with a printing defect recovery function which reduces the amount of time a brush is operated for removing the paper particles and dust.

In accordance with the present invention, to overcome the above-described difficulties, in a recording apparatus with an ink jet print head which forms dots on a recording sheet by ink jets shot by an array of nozzles, a microcomputer determines whether a printing defect is a light printing defect, that is, a defect caused by paper particles and dust stuck to the nozzles, or a heavy printing defect, that which is a defect caused by air bubbles entering the ink flow paths. The determination is made on the basis of intervals of operating a print recovery button mounted on a chassis of the recording apparatus.

For light printing defects, the computer instructs the placement of a cap member on the front face of the nozzles of the print head and the application of a negative pressure to the nozzles, thereby to reduce the amount of ink emitted from the nozzles. For heavy printing defects, the computer increases the amount of ink jetted.

BRIEF DESCRIPTION OF THE DRAWINGS

Other objects, features and advantages of the present invention will be apparent from the following detailed description taken in connection with the accompanying drawings, in which.

DESCRIPTION OF THE PREFERRED EMBODIMENTS

Figure 1:
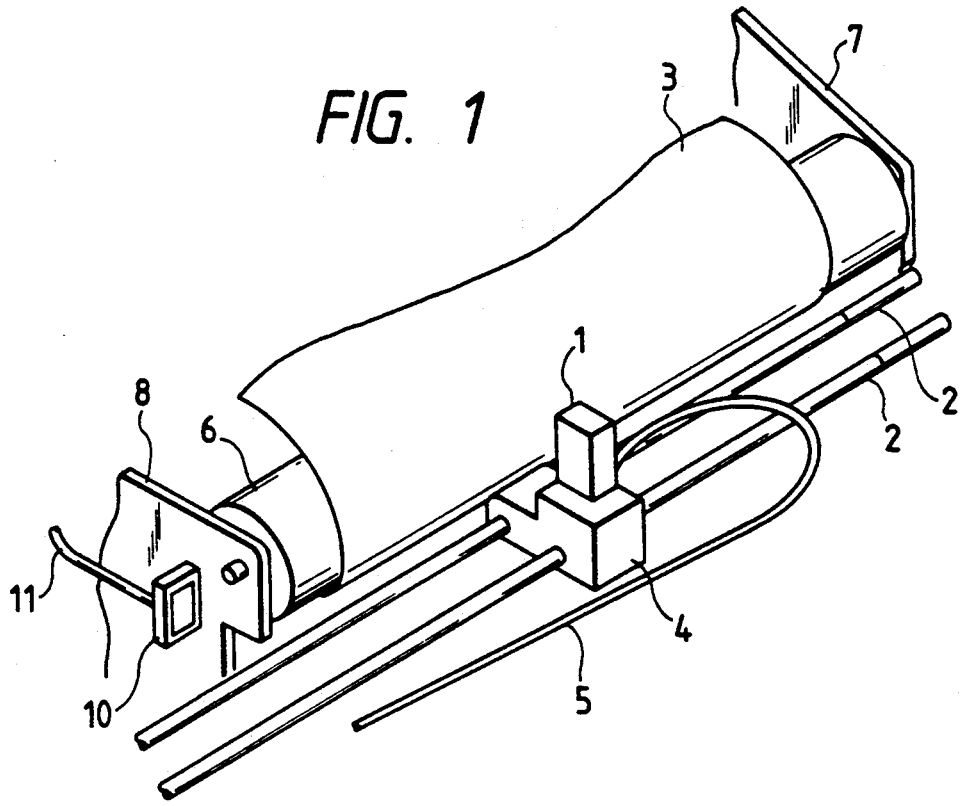
FIG. 1 is a perspective view showing an outline of an ink jet printer according to the present invention.

FIG. 1 is a perspective view showing the construction of an ink jet printer according to the present invention. In the figure, reference numeral 1 designates an ink jet print head having an array of nozzles. The print head is disposed with the openings of the nozzles facing a print surface. The print head is mounted on a carriage 4 which reciprocatively moves in the direction of width of a recording sheet 3 along a pair of guide rails 2 and 2. An ink tank (not shown) supplies ink through a tube 5 to the print head 1. Reference numeral 6 designates a platen to support the recording sheet 3. The platen 6 is rotatably supported at both ends by a pair of base plates 7 and 9. A cap member 10, which is to be in contact with the front face of the print head 1, is disposed on the left side of the base plate 8 and out of a print region. The cap member 10 communicates with a suction pump by means of a tube 11.

Figure 2:
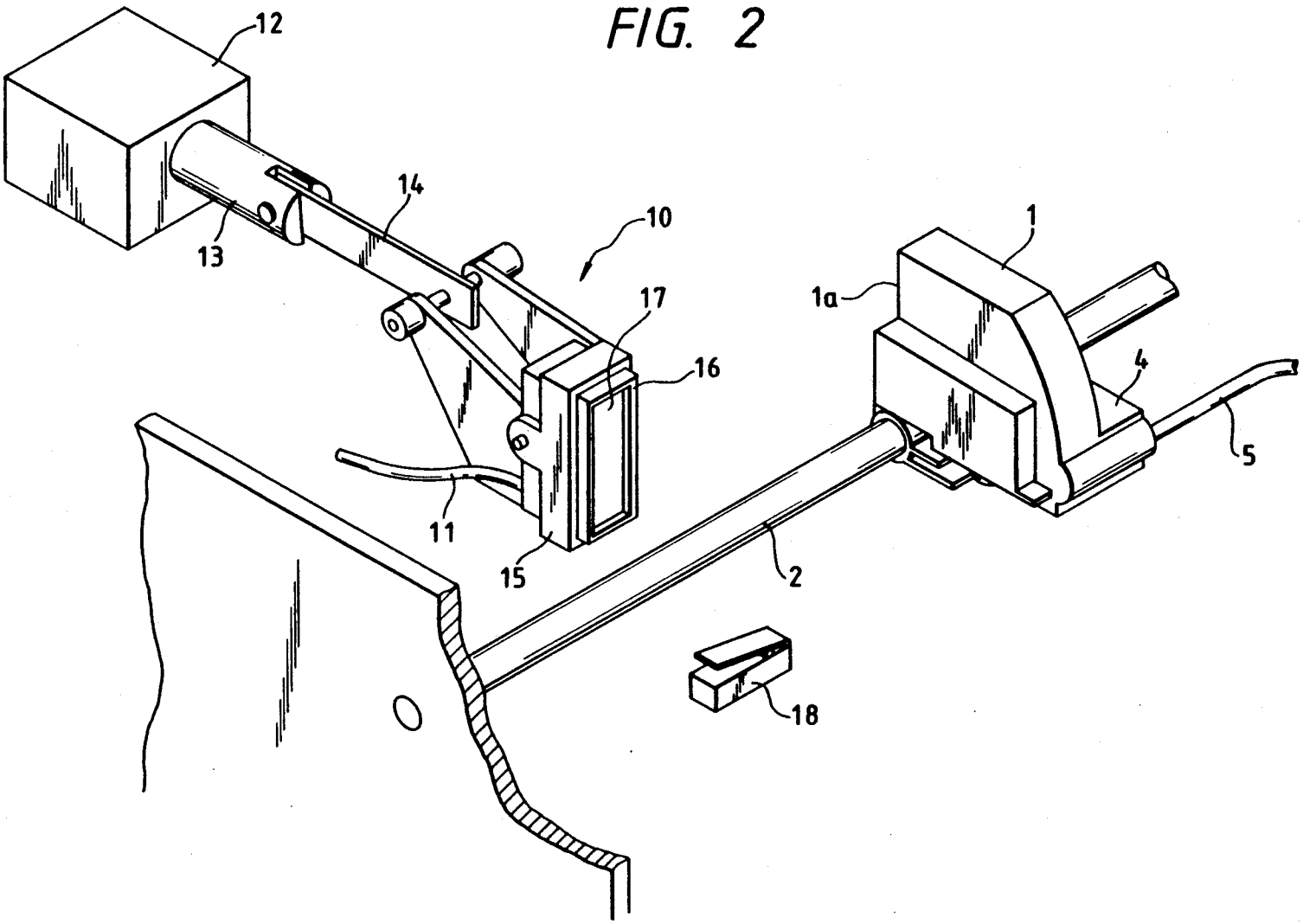
FIG. 2 is a perspective view showing in detail a cap member of the ink jet printer of FIG. 2 and a structure around the cap member.

FIG. 2 is a perspective view showing the details of the cap member 10. As shown, the cap member 10 is retractably coupled with a solenoid 12 by means of a rod 13 and an arm 14. In the cap member 10, a resilient member 16, which is provided on a base member 15, is shaped so as to enclose the front end containing a nozzle face 1*a* of the print head 1, and defines a nozzle receiving chamber 17. A negative pressure as transferred from a pump 20 (described in detail below) enters the nozzle receiving chamber 17. A position detector 18, when contacted the carriage 4, produces a signal. To be more specific, when the print head 1 moves and faces the cap member 10, the carriage 4 comes in contact with the position detector 18. Then, the detector produces a signal and sends it to a control circuit 26 to be described later. Under control of the control circuit 26, the solenoid 12 is driven to move the base member 15 of the cap member toward the nozzle face 1*a*. Finally, the cap member 10 hermetically seals the nozzle face 1*a* of the print head 1.

Figure 3:
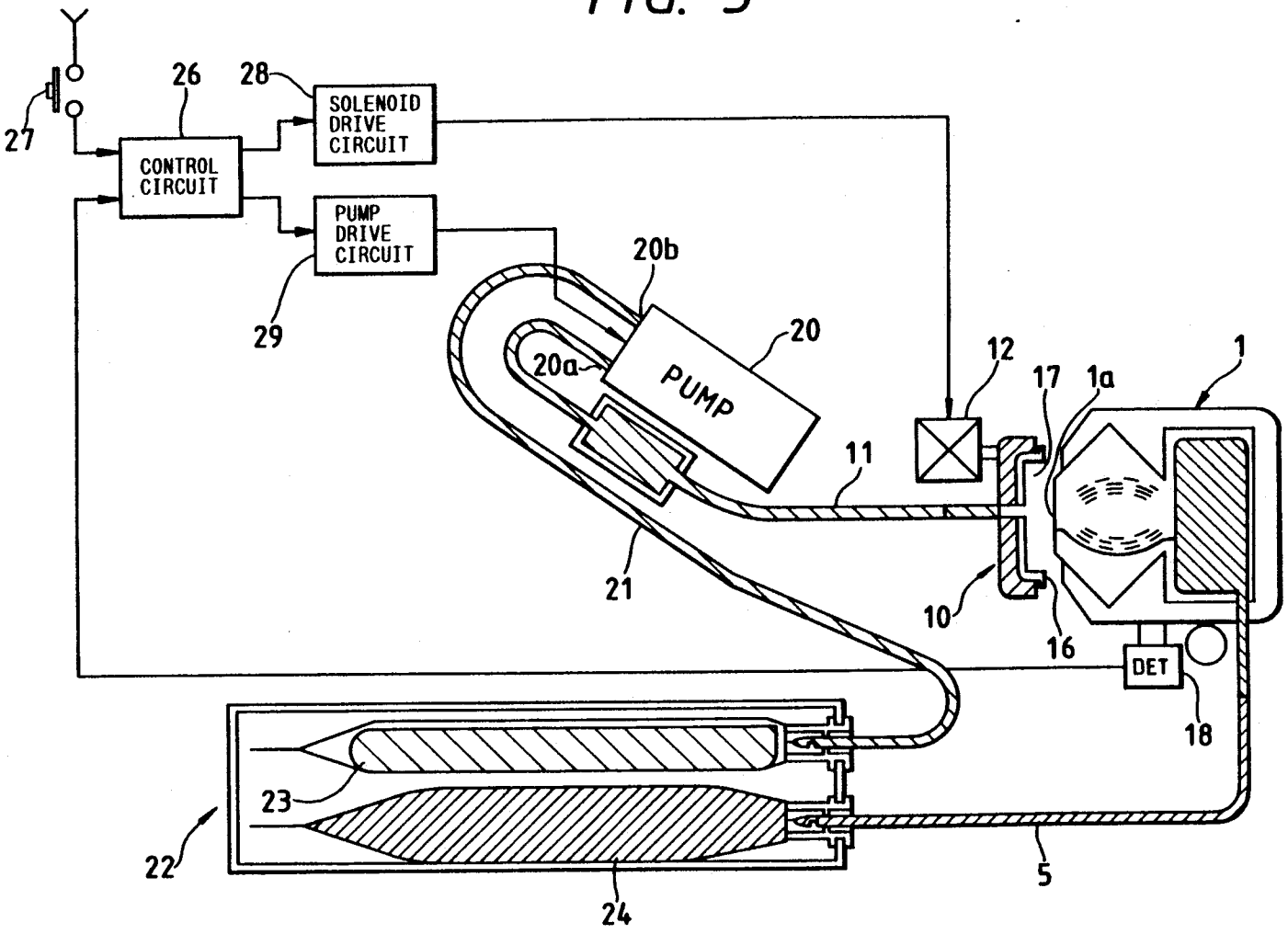
FIG. 3 is a block and schematic view showing an arrangement including ink flow paths of the printer of FIG. 1 and its control unit.

FIG. 3 is a block and schematic diagram showing an arrangement of the printer containing an ink supply flow system, an ink suction flow system operating in a print recovery mode, and a control system for print recovery. A suction pump 20 is coupled at the suction port 20*a* with the nozzle receiving chamber 17 of the cap member 10 by way of the tube 11, and at the discharge port 20*b* with a used-ink tank 23 of an ink cartridge 22 by way of a tube 21. An ink tank 24 contained in the cartridge 22 is connected to the print head 10 by way of a tube 5.

Figure 4:
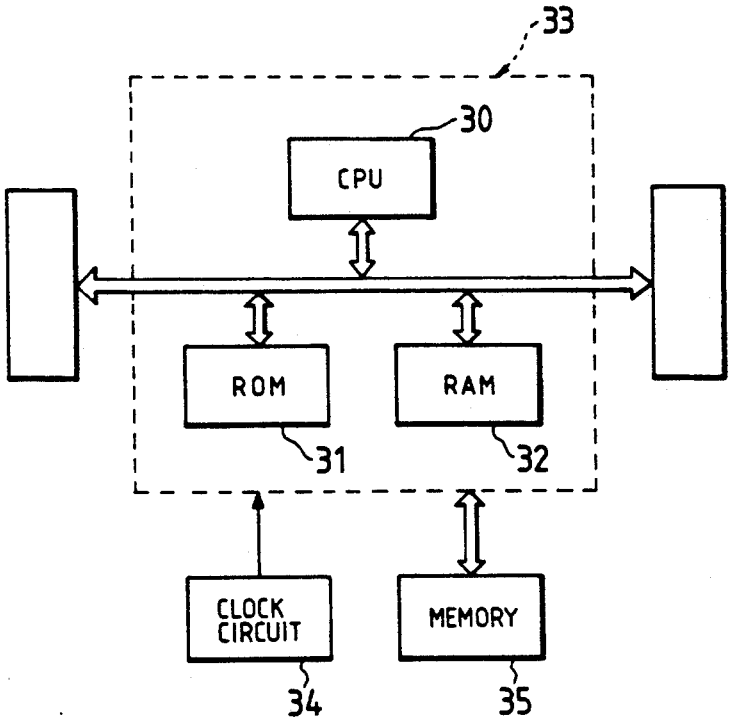
FIG. 4 is a block diagram showing the control unit when it is realized using a microcomputer.

The control circuit 26, which executes sequences of print recovery process steps, is arranged as shown in FIG. 4. The control circuit 26 is composed of a microcomputer 33 including a CPU 30, a ROM 31 and a RAM 32, a clock circuit 34, and a memory 35 for storing time data representative of time of pushing of the recovery button 27. The circuit 26 is programmed so as to execute a sequence of operations as given below. When the recovery button 27, which is provided on an operating panel of the printer chassis, is pushed, the position detector 18 produces a signal. At this time, the control circuit sends a signal to the solenoid drive circuit 28 (FIG. 3). In turn, the drive circuit 28 drives the solenoid 12 to press the cap member 10 against the print head 1. Then, the control circuit sends a signal to the pump drive circuit 29 to operate the suction pump 20 for a preset time.

Figure 5:
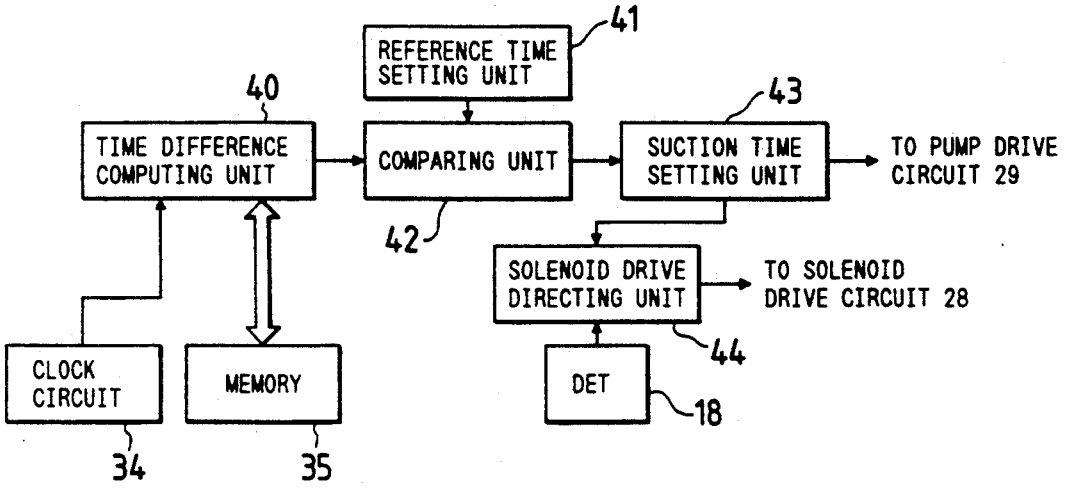
FIG. 5 is a block diagram showing a model of functions realized by the microcomputer.

FIG. 5 is a functional block diagram showing a model of the function to be realized by the microcomputer 33. The circuit is composed of time difference computing unit 40, reference time setting unit 41, comparing unit 42, suction time setting unit 43, and solenoid drive unit 44. The time difference computing unit 40 computes a time difference $\Delta T$ between time data of the previous pushing of the recovery button 27 as stored in the memory 35 and the time of the present pushing. The reference time setting unit 41 stores a reference time $T_O$ to determine a type of printing defect. The comparing unit 42 compares the time difference $\Delta T$ derived from the time difference computing unit 40 with the reference time $T_O$. The suction time setting unit 43 selects a suction time $T_S$ long enough to wash away paper particles and dust or a suction time $T_L$ long enough to remove air bubbles on the basis of the result of the comparison. The solenoid drive unit 44 energizes the solenoid 12 by a signal from the position detector 18, and de-energized the same when the suction is completed.

Figure 7:
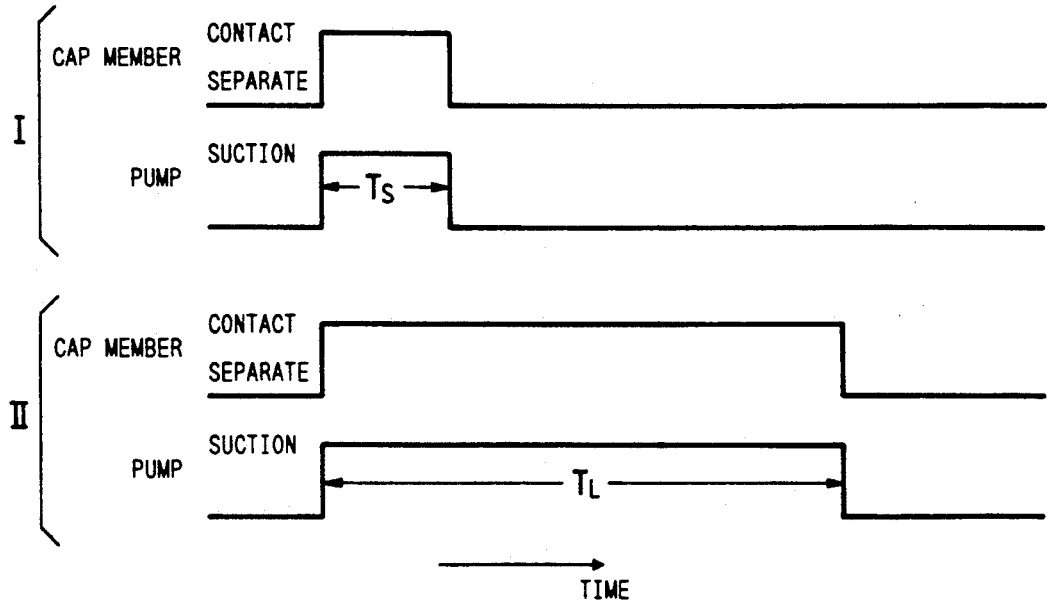
FIGS. 6 and 7 are respectively a flow chart and a timing chart showing a sequence of operations carried out by the circuit arrangement of FIG. 5.
Figure 6:
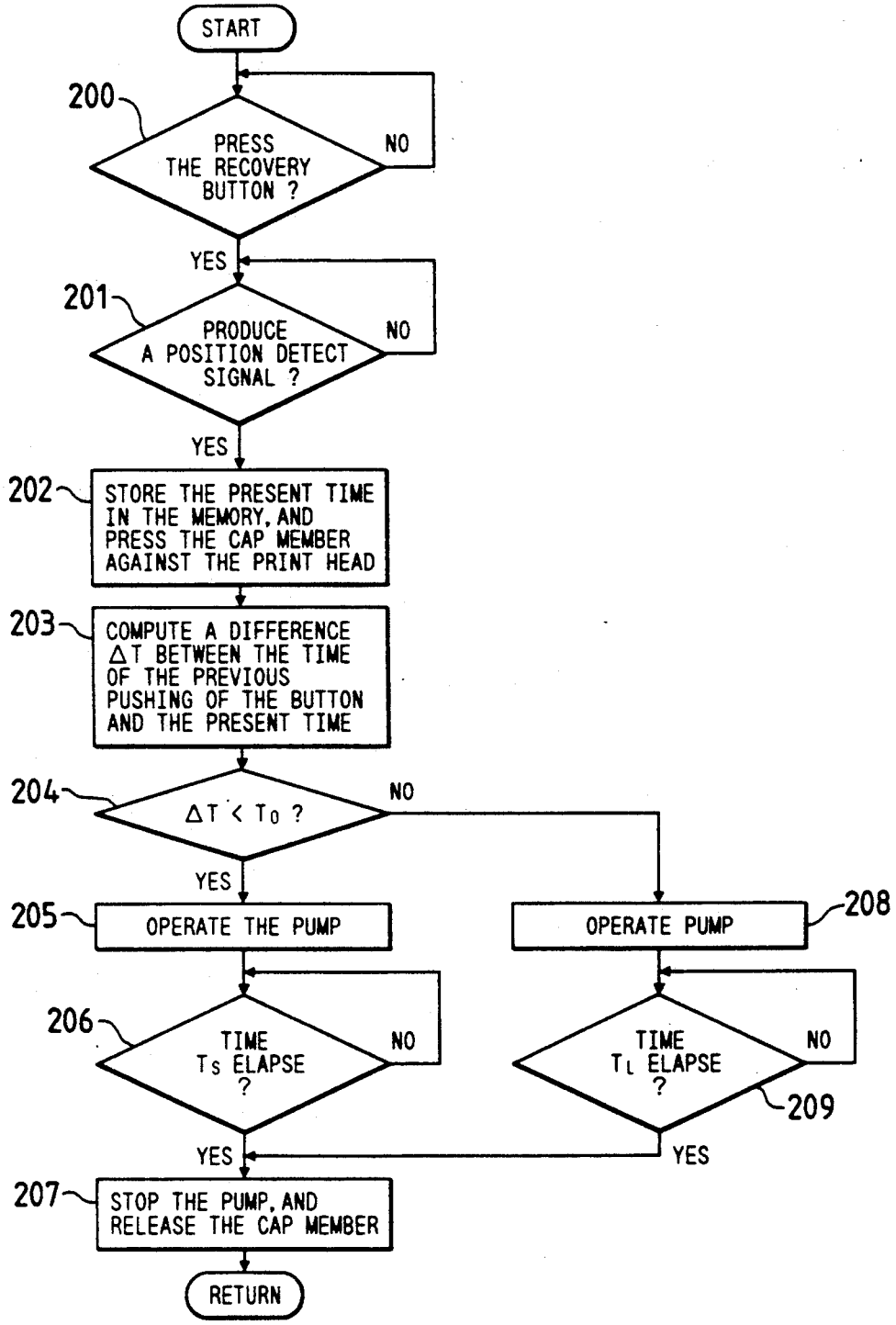

The operation of the apparatus thus arranged will be described with reference to FIGS. 6 and 7 respectively showing a flow chart and a timing chart.

When a printing defect is found, a user pushes the recovery button 27, which is provided on the chassis of the printer (step 200). Then, the carriage 4 is moved toward the cap member 10 under control of a carriage control circuit (not shown). The carriage 4 faces the cap member 10. At this time, the position detector 18 produces a signal (step 201). In response to the signal, the microcomputer 33 stores time data $t_1$ derived from the clock circuit 34, and then sends a signal to the solenoid drive circuit 28 to energize the solenoid 12. As a result, the cap member 10 hermetically closes the nozzle face 1*a* of the print head 1 (step 202). The microcomputer 33 computes a time difference between time $t_1$ the button 27 generates a signal and time $t_0$ of the previous pushing of the button 27, viz., $\Delta T = t_1 - t_0$ (step 203). The present pushing of the button is the first pushing after power on.

Accordingly, the CPU determines that the time difference $\Delta T$ is longer than the reference time $T_O$ (step 204). The reference time $T_O$ is the time that will elapse until the nozzles get clogged by foreign material, such as paper particles and dust, when the printer is operated in an ordinary printing mode, and is usually approximately five to ten hours. Printing defects due to foreign material adhering to the nozzle openings occur on the average of about five to ten hours after the printer is continuously operated, although the time depends on ambient conditions of the printer installed and the quality of paper. This fact was experimentally confirmed by the present inventors.

Then, the computer 33 issues a signal to the pump drive circuit 29, so that the suction pump 20 is operated to generate a negative pressure in the nozzle receiving chamber 17 of the cap member 10 (step 205). The negative pressure acts on the nozzle face 1*a* to extract ink through the nozzle openings. With the flow of the ink, paper particles and dust sticking to the nozzle openings are washed away. When time $T_S$, that is, the time taken until the pump has sucked an amount of ink necessary for removing the foreign material, elapses, viz. the time necessary for sucking ink of approximately 0.5 cc (this ink amount is denoted as $Q_a$) elapses (FIG. 7, waveforms I), the microcomputer 33 stops the operation of the pump 20, and at the same time de-energizes the solenoid 12 to separate the cap member 10 from the print head 1 (step 207). Under this condition, the print head 1 is operable in a print region and starts the printing operation again.

A printing defect occurs again after a relatively short time of ten and several minutes to one hour from the previous pushing of the button 27. After recognizing the printing defect, the user pushes the button 27 again (step 200). Then, the carriage 4 is moved and reaches the position of the cap member 10, and the position detector 18 produces a signal (step 201). At this time, the microcomputer 33 stores time data 12 from the clock circuit 34 into the memory 35, and sends a signal to the solenoid drive circuit 28. As a result, the cap member 10 is pressed against the nozzle openings of the print head 1 (step 202). The microcomputer 33 computes a time difference between time $t_1$ of the previous ink suction as stored in the memory 35, and time $t_2$ of the present ink suction, viz., $\Delta T = t_2 - t_1$ (step 203). Then, it compares the difference time with the reference time $T_O$ (step 204). In the present case, the time difference $\Delta T$ $(=t_2 - t_1)$ is much shorter than the reference time $T_O$. This indicates a high probability that the cause of the present printing defect is not foreign material stuck to the nozzle openings, but air bubbles entering the ink path. On the basis of the fact that the recovery button 27 is pushed again within the time shorter than the reference time $T_O$, the computer 33 selects the suction time $T_L$ longer than the suction time $T_S$ necessary for removing the foreign material.

When the nozzle face 1*a* of the print head 1 is hermetically closed by the cap member 10, the computer operates the pump 20 to apply a negative pressure to the nozzle receiving chamber 17 of the cap member 10 (step 208). Upon the negative pressure acting on the nozzle face 1*a*, ink is discharged from the ink flow path through the nozzle openings into the nozzle receiving chamber. Together with the discharged ink, the air bubbles are attracted toward the nozzle openings and discharged outside from the nozzles (FIG. 7, waveforms II). At the instant that the time $T_L$ necessary for sucking ink of approximately 2 cc (this ink amount is denoted as $Q_2$) elapses (step 209), the microcomputer 33 stops the operation of the pump 20, and deenergizes the solenoid 12 to separate the cap member 10 from the nozzle openings. Under this condition, the carriage 4 is movable in the print region (step 207).

When the recovery button 27 is pushed after five to ten hours from time point $t_2$ of the previous pushing of the button 27 (step 200), as in the previous case, the carriage 4 retracts to the position of the cap member 10 and the position detector 18 produces a signal. At this time (step 201), the microcomputer 33 stores the time data $t_3$ as applied from the clock circuit 34 into the memory 35, and then sends a signal to the solenoid drive circuit 28. By the signal, the solenoid 12 is energized to make the cap member 10 contact with the print head 1 (step 202).

The microcomputer 33 computes the time difference between time $t_2$ of the previous pushing of the recovery button 27 as stored in the memory 35 and time $t_3$ of the present pushing, $\Delta T = t_3 - t_2$ (step 203). Then, it compares the time difference with the reference time $T_O$ (step 204). In the present case, the time difference $\Delta T$ $(=t_3 - t_2)$ is longer than the reference time $T_O$, the microcomputer 33 selects the suction time $T_S$, so that the ink is sucked by the small ink amount $Q_S$ printing defect due to the foreign material (FIG. 7, waveforms I). Succeedingly, the steps (206) and (207) will be executed. As a consequence, foreign material, such as paper particles and dust, are washed away from the nozzle openings with the discharged ink, and the printer is made ready for printing.

As described above, in the ink jet printer of the instant embodiment, the type of printing defect is determined on the basis of the time interval between the pushings of the recovery button. The amount of ink to be sucked is set according to the result of this determination. To cure light printing defects due to the foreign material stuck to the nozzle openings, a small amount of ink is sucked. To cure heavy printing defects, a large amount of ink is sucked. Accordingly, the number of pushings of the recovery button a required for curing heavy printing defects is reduced, and hence the printer can be quickly recovered from its abnormal state.

In a case where light printing defects due to foreign material and heavy printing defects due to air bubbles substantially alternately occurred, the amounts of ink consumed by a conventional printer and the printer of the instant embodiment were measured. The results of the measurement are shown in Table 1. As seen, the conventional printer, in which the amount of sucked ink was set at 2 cc for both light and heavy printing defects, totally consumed 14 cc of ink. On the other hand, the printer of the instant embodiment consumed only 7.5 cc. This figure is the half of that of the conventional printer.

TABLE 1

| Cause of ink discharge trouble | Ink consumption by conventional printer | Ink consumed by printer of the invention |
|---|---|---|
| Paper particles | 2 cc | 0.5 cc |
| Paper particles | 2 | 0.5 |
| Paper particles | 2 | 0.5 |
| Air bubbles | 2 | 0.5 + 2 |
| Paper particles | 2 | 0.5 |
| Air bubbles | 2 | 0.5 + 2 |
| Paper particles | 2 | 0.5 |
| Total ink consumption | 14 cc | 7.5 cc |

Figure 8:
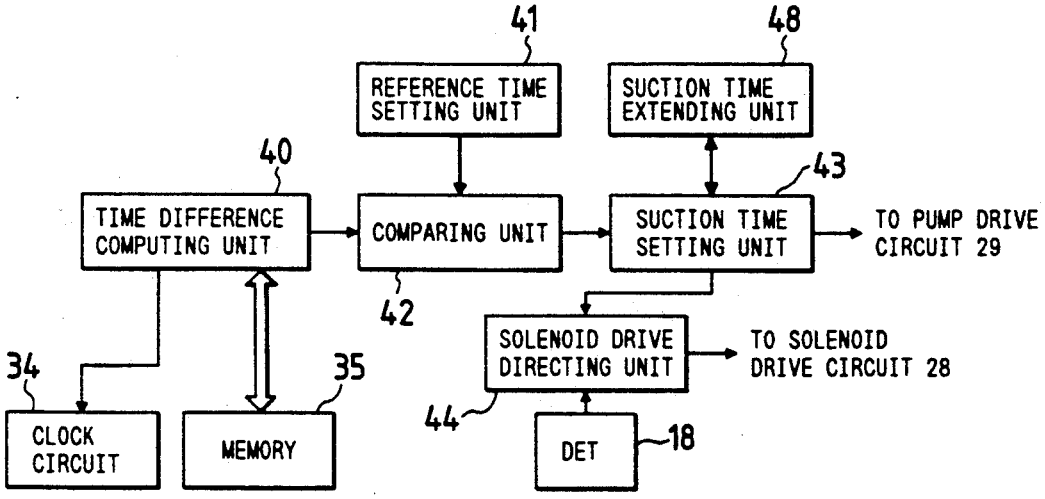
FIG. 8 is a block diagram showing a circuit arrangement employed to realize a function by the microcomputer contained in the control circuit, which is a second embodiment of the present invention.

FIG. 8 shows a second embodiment of the present invention in terms of the functions to be realized by the microcomputer 33 constituting the control circuit 26. As shown, the control circuit is composed of time difference computing unit 40, reference time setting unit 41, comparing unit 42, suction time setting unit 43, solenoid drive unit 44, and suction time prolong unit 48. The time difference computing unit 40 computes a time difference $\Delta T$ between time data as stored in the memory 35 and the times of pushing the recovery button. The reference time setting unit 41 stores a reference time $T_O$ to determine the type Of printing defect. The comparing unit 42 compares the time difference $\Delta T$ derived from the time difference computing unit 40 with the reference time $T_O$. The suction time setting unit 43 selects a suction time $T_S$ long enough to wash away paper particles and dust or a suction time $T_L$ long enough to remove air bubbles on the basis of the result of the comparison. The solenoid drive unit 44 energizes the solenoid 12 with a signal from the position detector 18, and de-energizes the same when suction is completed. When the recovery button 27 is pushed within the reference time $T_O$ after the completion of the suction for the section time $T_L$, the suction time extending unit 48 increments the suction time by a fixed time $\Delta T_a$ every N number of pushings of the recovery button.

Figure 10:
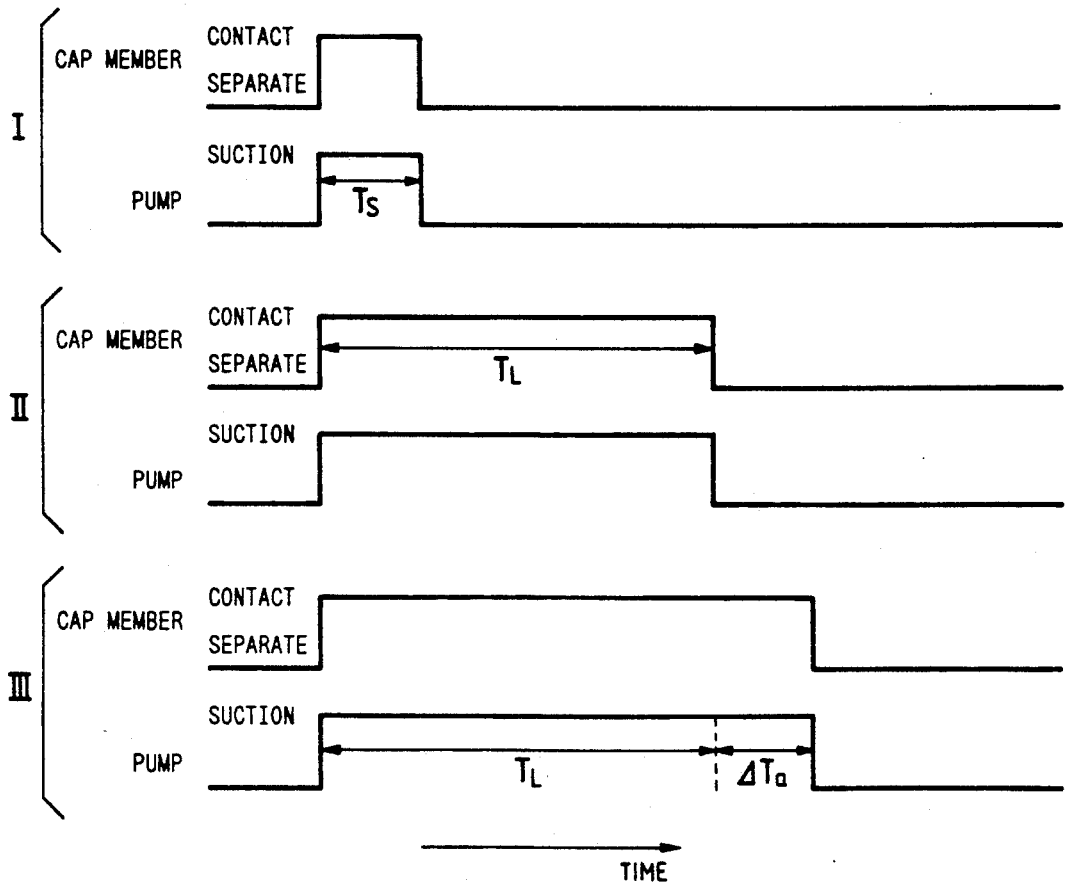
FIGS. 9 and 10 are a flow chart and a timing chart showing a sequence of operations by the circuit arrangement of FIG. 8.
Figure 9:
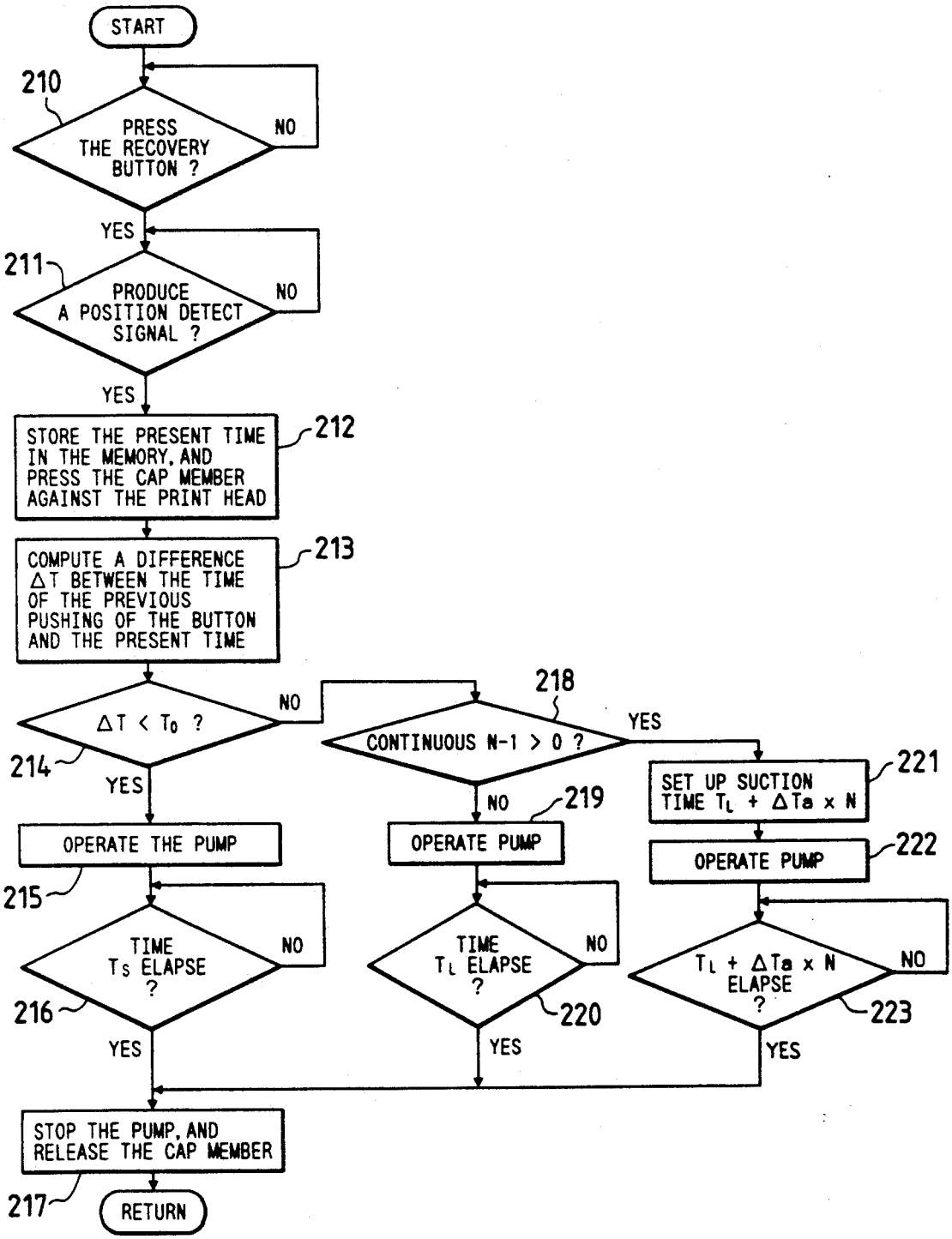

The operation of the circuit thus arranged will be described with reference to FIGS. 9 and 10 respectively showing a flow chart and a timing chart.

When a printing defect is found, the user pushes the recovery button 27, which is provided on the chassis of the printer (step 210). Then, the carriage 4 is moved toward the cap member 10 under the control of a carriage control circuit (not shown). The carriage 4 faces the cap member 10. At this time, the position detector 18 produces a signal (step 211). In response to the signal, the microcomputer 33 stores time data $t_1$ derived from the clock circuit 34, and then sends a signal to the solenoid drive circuit 28 to energize the solenoid 12. As a result, the cap member 10 hermetically closes the nozzle face 1*a* of the print head 1 (step 212). The microcomputer 33 computes the time difference between time $t_1$ the button 27 generates a signal and time $t_0$ of the previous pushing of the button 17, viz., $\Delta T = t_1 - t_0$ (step 213). Then, the microcomputer 33 compares the time difference $\Delta T$ with the reference time $T_O$ (step 214). Further, the microcomputer 33 issues a signal to the pump drive circuit 29, so that the suction pump 20 is operated to generate a negative pressure in the nozzle receiving chamber 17 of the cap member 10 (step 215). The negative pressure acts on the nozzle face to extract ink from the nozzle openings. With the flow of the ink, paper particles and dust stuck to the nozzle openings are washed away. When time $T_S$, which is the time taken until the pump has sucked an amount of ink necessary for removing the foreign material, elapses (step 216), the microcomputer 33 stops the operation of the pump 20, and at the same time de-energizes the solenoid 12 to separate the cap member 10 from the print head 1 (step 217; FIG. 10, waveforms I). Under this condition, the print head 1 is operable within the print region and starts the printing operation again.

In this example, the printing defect occurs again after a relatively short time of ten and several minutes to one hour from the previous pushing of the button 27. After recognizing the printing defect, the user pushes the button 27 again (step 210). Then, the carriage 4 is moved and reaches the position of the cap member 10, and the position detector 18 produces a signal (step 211). At this time, the microcomputer 33 stores time data $l_2$ from the clock circuit 34 into the memory 35, and sends a signal to the solenoid drive circuit 28. As a result, the cap member 10 is pressed against the nozzle openings of the print head 1 (step 212). The microcomputer 33 compares a time difference between time $t_1$ of the previous ink suction as stored in the memory 35, and time $t_2$ of the present ink suction, viz., $\Delta T = t_2 - t_1$ (step 213). Then, it compares the difference time with the reference time $T_O$ (step 214).

In the present case, the time difference $\Delta T$ $(=t_2 - t_1)$ is much shorter than the reference time $T_O$. This implies a high probability that the cause of the present printing defect is not foreign material stuck to the nozzle openings, but air bubbles entering the ink path. The microcomputer 33 operates the pump 20 (step 219), and stops the same after the time $T_L$ taken for sucking the amount $Q_L$ of ink, which is necessary for removing the air bubbles (step 220), and separates the cap member 10 from the print head 1 (step 217; FIG. 10, waveforms II).

In the case where the previous ink suction for the bubble removal imperfectly removes the air bubbles, the printing defect due to the air bubbles will occur again within a very short of time, e.g., ten and several minutes. If such printing defect occurs and the user pushes the recovery button 27 (step 210), the carriage 4 is moved to the position of the cap member 10 and the position detector 18 produces an output signal (step 211). At this time, the microcomputer 33 sends a signal to the solenoid drive circuit 28. Then, the cap member 10 is pressed against the nozzle openings of the print head 1 (step 212). At the same time, the microcomputer 33 fetches time data from the clock circuit 34, and computes a time difference between the time data $t_3$ and the time $t_2$ of the previous ink suction as stored in the memory 35, viz., $\Delta T = t_3 - t_2$ (step 213). Then, it compares the difference time with the reference time $T_O$ (step 214). In the case now discussed, the recovery button is operated again within a very short time, the microcomputer 33 increments the suction time $T_L$ for bubble removal by a preset time $\Delta T_a$ to be $T_L + \Delta T_a$ (step 221), and operates the operation of the pump 20 (step 122). After the incremented suction time $T_L + \Delta T_a$. the microcomputer stops the pump 20 and separates the cap member 10 from the print head 1 (step 217; FIG. 10, waveform's III).

Subsequently, when the pushing of the recovery button for the very short time is repeated, the suction time for the bubble removal is incremented by time $\Delta T \times N$ every N number of pushings to be $T_L + \Delta T \times N$ (step 221).

In the instant embodiment, even if the printing defect found is a heavy printing defect requiring frequent pushings of the recovery button, it can be cured by incrementing the amount of the ink to be sucked, with the feature of incrementing the suction time for the bubble removal.

The inventors conducted an experiment to cure a heavy printing defect due to air bubbles into the ink flow path. To cure the printing defect, two printers were used; one a conventional printer in which the amount of ink to be sucked is fixed at 2 cc, and the other a printer according to the instant embodiment which increments the amount of the sucked ink every time the recovery button is pushed. The results of the experiment are shown in Table 2.

TABLE 2

| Number of recovery operations | Conventional printer | Present Invention |
|---|---|---|
| 1st time | 2 | 1 |
| 2nd time | 2 | 2 |
| 3rd time | 2 | 3 |
| 4th time | 2 | 4 → Ready for print |
| 5th time | 2 → Ready for print | |
| Total ink consumption | 10 | 10 |

As seen from the table, when the conventional printer is used, a total of 10 cc of ink is discharged to cure the printing defect. In this case, the button was pushed five times. When the printer of the present invention is used, the same amount of ink was discharged, but it is only four times that the recovery button is pushed. Consequently, the table teaches that the printer of the invention can save the number of the pushings of the button by one time, and proportionally reduce the print rest time required for the ink suction operation.

In the embodiments described above, the interval between the operations of the recovery button is obtained from the time data of the clock circuit. If required, a timer unit operated in connection with the recovery button may be used for obtaining the button operation interval.

Further, in the above embodiments, the amount of sucked ink is determined on the basis of the time interval between button pushings. Alternatively, the ink suction time and the amount of sucked ink by the cap member can be determined on the basis of the quantities of print and paper feed.

Figure 11:
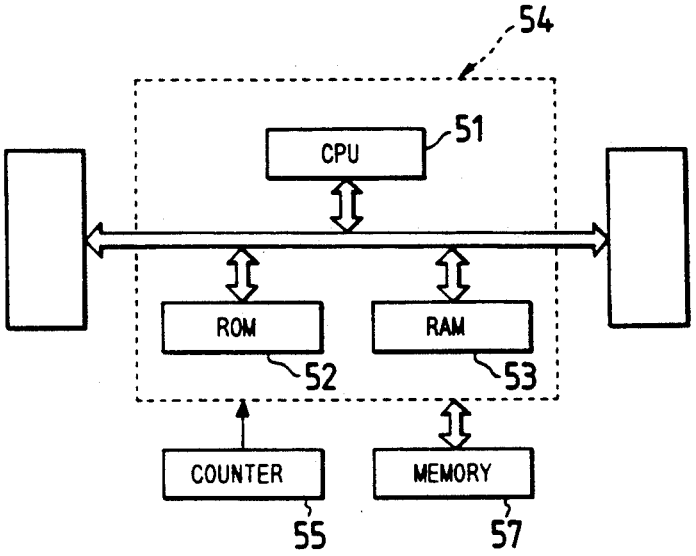
FIG. 11 is a block diagram showing a third embodiment of the present invention containing a control circuit as a major portion.

FIG. 11 shows a third embodiment of the present invention in the form of an arrangement of the control circuit 26. As shown, the control circuit 26 is composed of a microcomputer 54 including a CPU 51, a ROM 52 and a RAM 53, a counter 55 for counting a print quantity, such as the number of printed characters, the number of lines, and an amount of paper feed, and a memory 57 for storing data of the counted print quantity derived from the counter 55 when the recovery button 27 is pushed. It is programmed so as to execute a sequence of operations as given below. When the recovery button 27, which is provided on an operating panel of the printer chassis, is pushed, the position detector 18 shown in FIG. 2 produces a signal. At this time, the control circuit sends a signal to the solenoid drive circuit 28. In turn, the drive circuit 28 drives the solenoid 12 and control circuit sends a signal to the pump drive circuit 29 to operate the suction pump 20 for a preset time.

Figure 12:
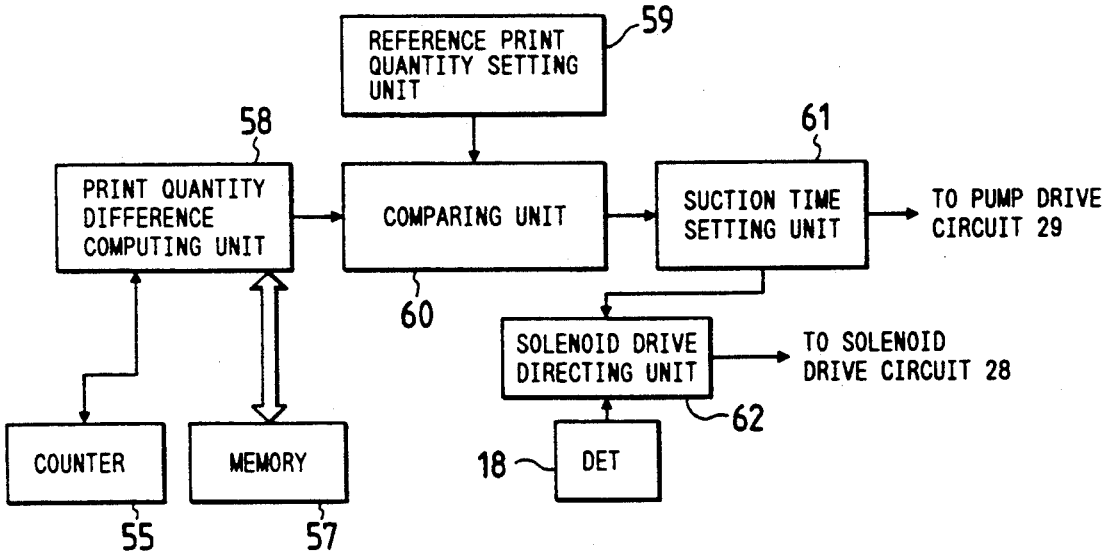
FIG. 12 is a block diagram showing a model of the function of a microcomputer constituting the control circuit in the third embodiment.

FIG. 12 is a functional block diagram showing a model of the function to be realized by the microcomputer 54. The circuit is composed of print quantity difference computing unit 58, reference print quantity setting unit 59, comparing unit 60, suction time setting unit 61, and solenoid drive directing unit 62. The print quantity difference computing unit 58 computes a print quantity difference $\Delta L$ between print quantity data stored in the memory 57 and data output from the counter 55 when the recovery button 27 is pushed. The reference print quantity setting unit 59 stores a reference print quantity $L_O$ to determine the type of printing defect. The comparing unit 60 compares the print quantity difference data from the print quantity difference computing unit 58 with the reference print quantity $L_O$. The suction time setting unit 61 selects a suction time $T_S$ long enough to wash away paper particles and dust or a suction time $T_L$ long enough to remove air bubbles on the basis of the result of the comparison. The solenoid drive directing unit 62 energizes the solenoid 12 by a signal from the position detector 18, and de-energizes the same when the suction is completed.

Figure 13:
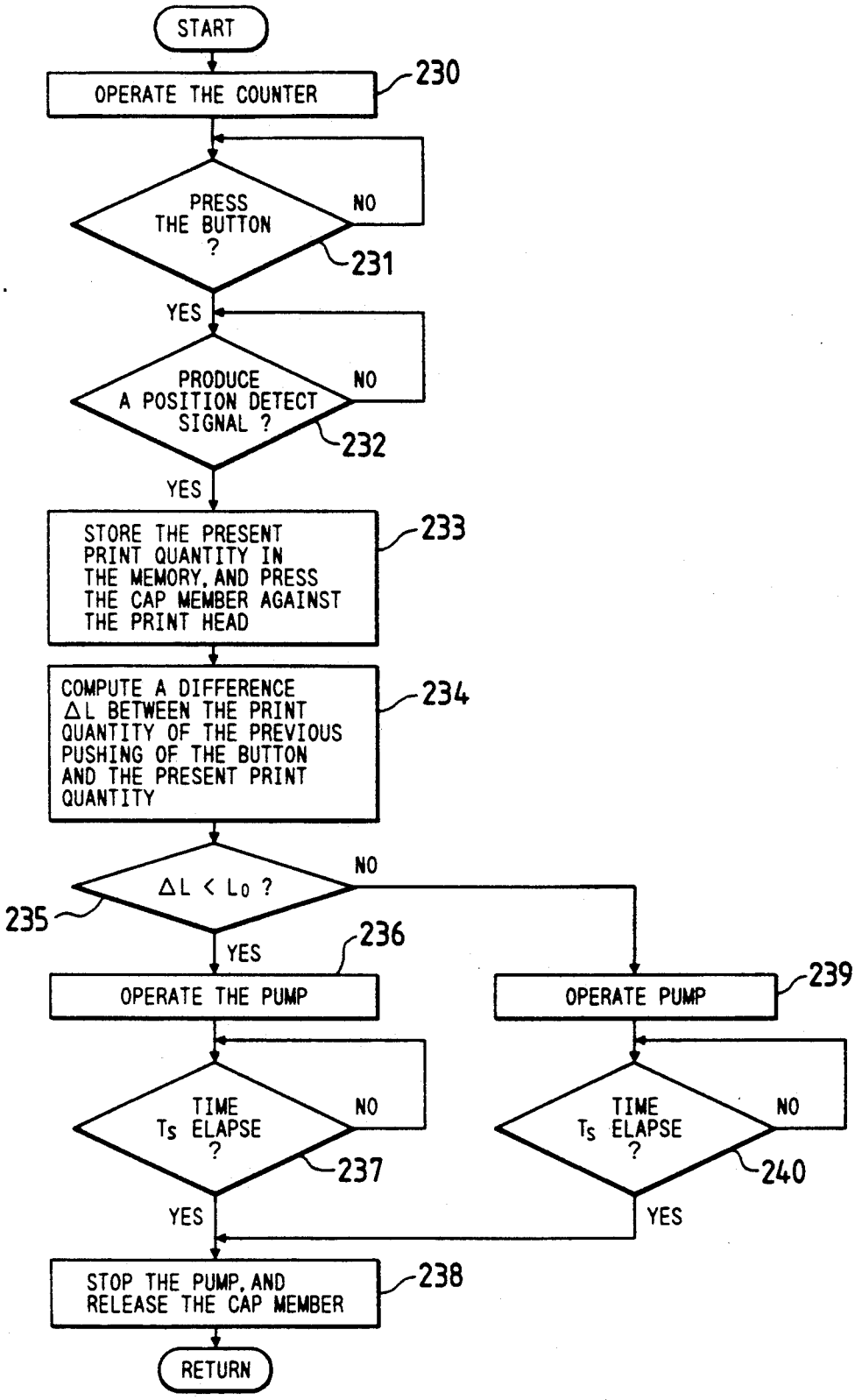
FIG. 13 is a flow chart showing an operation of the apparatus in the third embodiment.

The operation of the apparatus thus arranged will be described with reference to FIG. 13 showing a flow chart.

Upon start of a printing operation, the microcomputer 54 causes the counter 55 to count the print quantity (step 230). During the printing operation, if a printing defect is found, the user pushes the recovery button 27, which is provided on the chassis of the printer (step 231). Then, the carriage 4 is moved toward the cap member 10 under control of a carriage control circuit (not shown). The carriage 4 faces the cap member 10. At this time, the position detector 18 produces a signal (step 232). In response to the signal, the microcomputer 54 fetches the print quantity $l_1$ at the instant that the recovery button 27 produces a signal, and stores it in the memory 57. Further the microcomputer 54 sends a signal to the solenoid drive circuit 28 to energize the solenoid 12. As a result, the cap member 10 hermetically closes the nozzle face 1*a* of the print head 1 (step 233). The microcomputer 54 fetches from the counter 55 the print quantity $l_1$ until the recovery button 27 produces a signal, and stores it in the memory 57. Then, the microcomputer 54 computes a print quantity difference between the print quantity $l_1$ and a print quantity $l_0$ obtained in the previous pushing of the recovery button 27, viz., $\Delta L = l_1 - l_0$ (step 234). The present pushing of the button is the first pushing after power on. Accordingly, the CPU determines that the print quantity difference $\Delta L$ is larger than the reference print quantity $L_O$ (step 235). Then, the computer 54 issues a signal to the pump drive circuit 29, so that the suction pump 20 is operated to generate a negative pressure in the nozzle receiving chamber 17 of the cap member 10 (step 236). The negative pressure acts on the nozzle face 1*a* to extract ink through the nozzle openings. With the flow of the ink, paper particles and dust stuck to the nozzle openings are washed away. When time $T_S$, which is the time taken until the pump has sucked an amount of ink necessary for removing the foreign material, elapses (step 237), the microcomputer 54 stops the operation of the pump 20, and at the same time de-energizes the solenoid 12 to separate the cap member 10 from the print head 1 (step 238). Under this condition, the print head 1 is operable in a print region and starts the printing operation again.

A printing defect occurs again after a relatively short time of ten and several lines to several pages from the previous pushing of the button 27. After recognizing the printing defect, the user pushes the button 27 again (step 231). Then, the carriage 4 is moved and reaches the position of the cap member 10, and the position detector 18 produces a signal (step 232). At this time, the microcomputer 54 stores print quantity data $l_2$ from the counter 55 in the memory 57, and sends a signal to the solenoid drive circuit 28. As a result, the cap member 10 is pressed against the nozzle openings of the print head 1 (step 233). The microcomputer 54 computes a print quantity difference between the print quantity data $l_2$ from the counter 12 and the previous print quantity $l_1$ stored in the memory 57, and time $t_2$ of the present ink suction, viz., $\Delta L = l_2 - l_1$ (step 234). Then, it compares the difference print quantity with the reference print quantity (step 235). Where a light printing defect due to the foreign material stuck to the nozzles recurs, the interval between the first and second printing defects is usually within 250 lines of printing. The reference print quantity $L_O$ is selected on the basis of this figure (250) of the number of lines until the recovery button is pushed again.

The printing defect due to foreign material stuck to the nozzle openings, when the printer is continuously operated, will happen between approximately 1,000 and 10,000 lines, although the numbers of lines in a given situation will of course depend on ambient conditions and the quality of paper used. This fact was experimentally confirmed by the inventors.

In the present case, the print quantity difference $\Delta L$ $(=l_2 - l_1)$ is much smaller than the reference print quantity $L_O$. This indicates a high probability that the cause of the present printing defect is not foreign material stuck to the nozzle openings, but air bubbles entering the ink path. Accordingly, the computer 54 selects the suction time $T_L$, which is larger than the suction time $T_S$ necessary for removing the foreign material.

At the instant that the time $T_L$ to suck the satisfactory amount $Q_2$ of ink for discharging the air bubbles has elapsed (steps 239 and 240), the microcomputer 54 stops the operation of the pump 20, and de-energizes the solenoid 12 to separate the cap member 10 from the nozzle openings. Under this condition, the carriage 4 is movable in the print region (step 238).

When the recovery button 27 is pushed after the print of 250 to 1,000 lines is made further to the quantity $l_2$ of the print made by the previous pushing of the button 27, the carriage 4 retracts to the position of the cap member 10 and the position detector 18 produces a signal. At this time (step 232), the microcomputer 54 stores the time data 13, which comes from the clock circuit 34, in the memory 57, and then sends a signal to the solenoid drive circuit 28. By this signal, the solenoid 12 is energized to make the cap member 10 contact with the print head 1 (step 233).

The microcomputer 54 computes a print quantity difference between the print quantity $l_2$ of the previous pushing of the recovery button 27 as stored in the memory 57 and print quantity $l_2$ of the present pushing, $\Delta L = l_3 - l_2$ (step 235). Then, it compares the print quantity difference with the reference print quantity $L_O$ (step 235). In the present case, the print quantity difference $\Delta L$ $(=l_3 - l_2)$ is larger than the reference print quantity $L_S$, so that the ink is sucked by the small ink amount $Q_S$ for the printing defect due to the foreign material (FIG. 7, waveforms I). Succeedingly, the steps (237) and (238) are executed. As a consequence, the foreign material, such as paper particles and dust, is washed away from the nozzle openings with the discharged ink, and the printer is made ready for printing.

As described above, the ink jet printer of the instant embodiment detects the amounts of paper particles and dust, which are proportional to the print quantity. Accordingly, the recovery of the printer from the printing defect is quickened.

Figure 14:
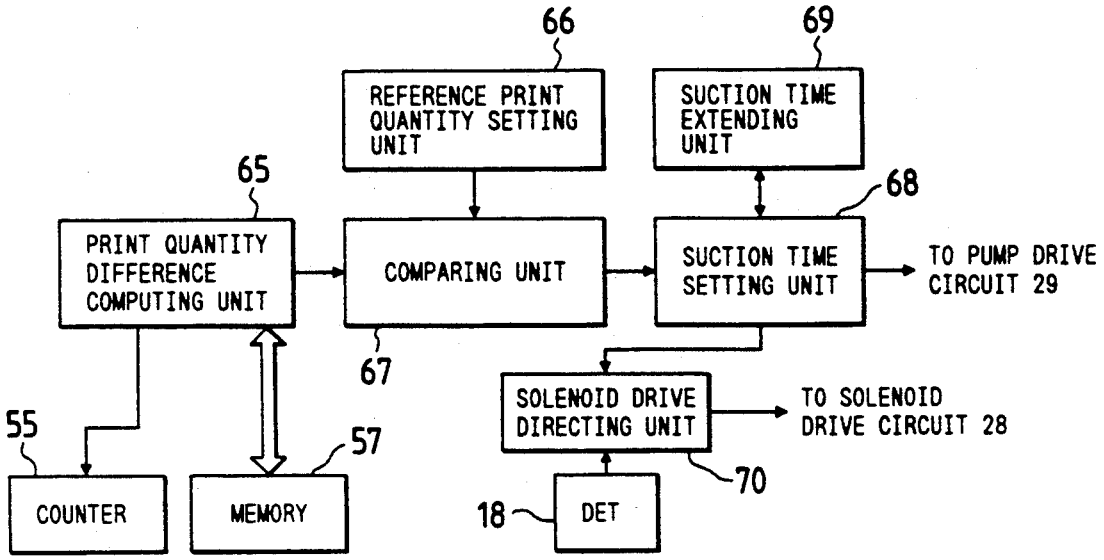
FIG. 14 is a block diagram showing a fourth embodiment of the present invention in terms of the function that is executed by a microcomputer.

FIG. 14 shows a fourth embodiment of the present invention in terms of the function to be realized by the microcomputer 54. The circuit is composed of print quantity difference computing unit 65, reference print quantity setting unit 66, comparing unit 67, suction time setting unit 68, suction time prolong unit 69, and solenoid drive unit 70. The print quantity difference computing unit 65 computes a print quantity difference $\Delta L$ between print quantity data stored in the memory 57 and data output from the counter 55 when the recovery button 27 is pushed. The reference print quantity setting unit 66 stores a reference print quantity $L_O$ to determine the type of printing defect. The comparing unit 67 compares the print quantity difference data from the print quantity difference computing unit 65 with the reference print quantity $L_O$. The suction time setting unit 68 selects a suction time $T_S$ long enough to wash away paper particles and dust or a suction time $T_L$ long enough to remove air bubbles on the basis of the result of the comparison. When the recovery button 27 is pushed within the reference print quantity $L_O$ after the completion of the suction for the suction time $T_L$, the suction time extending unit 69 increments the suction time by fixed time $T_a$ every N number of pushings of the recovery button. The solenoid drive unit 70 energizes the solenoid 12 by a signal from the position detector 18, and de-energizes the same when the suction is completed.

Figure 15:
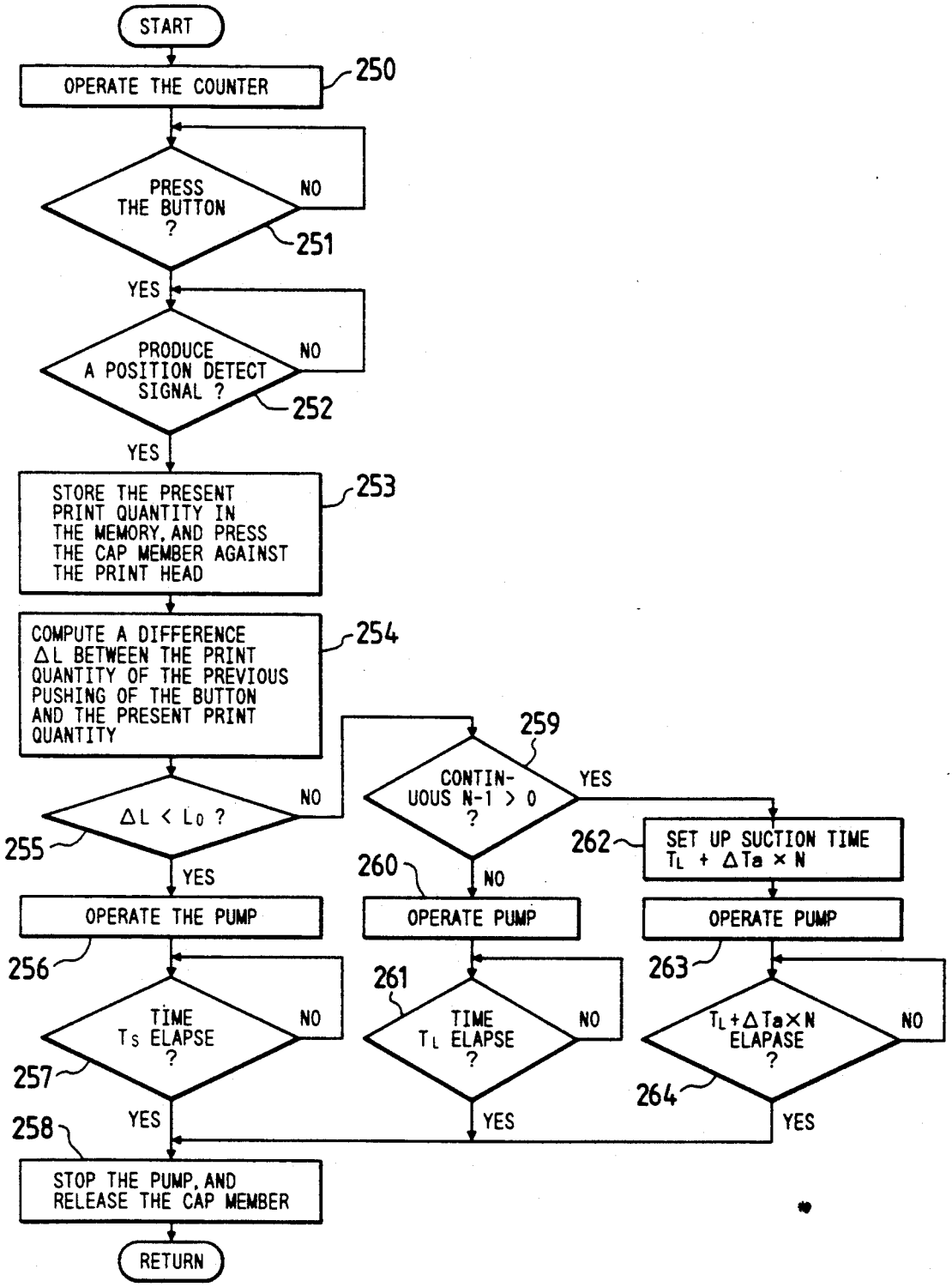
FIG. 15 is a flow chart showing an operation of the apparatus in the fourth embodiment.

The operation of the apparatus thus arranged will be described with reference to FIG. 15 showing a flow chart.

Upon start of a printing operation, the microcomputer 54 causes the counter 55 to count the print quantity (step 250). During the printing operation, if a printing defect is found, the user pushes the recovery button 27, which is provided on the chassis of the printer (step 251). Then, the carriage 4 is moved toward the cap member 10 under control of a carriage control circuit (not shown). The carriage 4 faces the cap member 10. At this time, the position detector 18 produces a signal (step 252). In response to the signal, the microcomputer 54 fetches the print quantity $l_1$ at the instant that the recovery button 27 produces a signal, and stores it in the memory 57. Further, the microcomputer 54 sends a signal to the solenoid drive circuit 28 to energize the solenoid 12. As a result, the cap member 10 is pressed against the print head 1 (step 253). Then, the computer 54 issues a signal to the pump drive circuit 29, so that the suction pump 20 is operated to generate a negative pressure in the nozzle receiving chamber 17 of the cap member 10 (step 256). The negative pressure acts on the nozzle face 1*a* to extract ink through the nozzle openings. With the flow of the ink, paper particles and dust stuck to the nozzle openings are washed away. When time $T_S$, which is the time taken until the pump has sucked an amount of ink necessary for removing the foreign material, elapses (step 257), the microcomputer 54 stops the operation of the pump 20, and at the same time de-energizes the solenoid 12 to separate the cap member 10 from the print head 1 (step 258). Under this condition, the print head 1 is operable in a print region and starts the printing operation again.

A printing defect occurs again after a relatively short time of several lines to several pages from the previous pushing of the button 27. After recognizing the printing defect, the user pushes the button 27 again (step 251). Then, the carriage 4 is moved and reaches the position of the cap member 10, and the position detector 18 produces a signal (step 252). At this time, the microcomputer 54 stores print quantity data $l_2$ from the counter 55 in the memory 57, and sends a signal to the solenoid drive circuit 28. As a result, the cap member 10 is pressed against the nozzle openings of the print head 1 (step 253). The microcomputer 54 computes a print quantity difference between the print quantity data $l_2$ from the counter 13 and the previous print quantity $l_2$ stored in the memory 57, and print quantity $l_2$ of the present ink suction, viz., $\Delta L = l_3 - l_2$ (step 254). Then, it compares the difference print quantity with the reference print quantity $L_O$ (step 255).

In the case now discussed, the recovery button is operated again within a very short time (step 259), the microcomputer 54 increments the suction time $T_L$ for the bubble removal by a preset time $\Delta T_a$ to be $T_L + \Delta T_a$ (step 262), and operates the operation of the pump 20 (step 263). After the incremented suction time $T_L + \Delta T_a$ (step 264), the microcomputer stops the pump 20 and separates the cap member 10 from the print head 1 (step 258).

In case where the previous ink suction operation for bubble removal has imperfectly removed the air bubbles, the printing defect due to the air bubbles will occur again within a very short of time, e.g., ten and several minutes. If such printing defects occurs and a user pushes the recovery button 27 (step 251), the carriage 4 is moved to the position of the cap member 10 and the position detector 18 produces an output signal (step 252). At this time, the microcomputer 33 stores the print quantity $l_3$ of the counter 55 into the memory 57, and sends a signal to the solenoid drive circuit 28. Then, the cap member 10 is pressed against the nozzle openings of the print head 1 (step 253). At the same time, the microcomputer 33 computes a time difference between the print quantity $l_3$ and the previous print quantity $l_2$ stored in the memory 57, viz., $\Delta L = l_3 - l_2$ (step 254). Then, the microcomputer 33 compares the difference time with the reference print quantity $L_O$ (step 255). In the case now being discussed, the recovery button is operated again within a very short time (step 259), the microcomputer 33 increments the suction time $T_L$ for bubble removal by the preset time $\Delta T_a$ to be $T_L + \Delta T_a$ (step 262), and operates the operation of the pump 20 (step 263). After the incremented suction time $T_L + \Delta T_a$ elapses (264), the microcomputer stops the pump 20 and separates the cap member 10 from the print head 1 (step 258).

Subsequently, when the pushing of the recovery button for the very short time is repeated, the suction time for the removal is incremented by time $\Delta T \times N$ every N number of pushings to be $T_L + \Delta T \times N$ (step 262).

In the instant embodiment, even if the printing defect found is a heavy printing defect requiring frequent pushings o the recovery button, it can be cured by incrementing the amount of the ink to be sucked, with the feature of incrementing the suction time for bubble removal.

Figure 16:
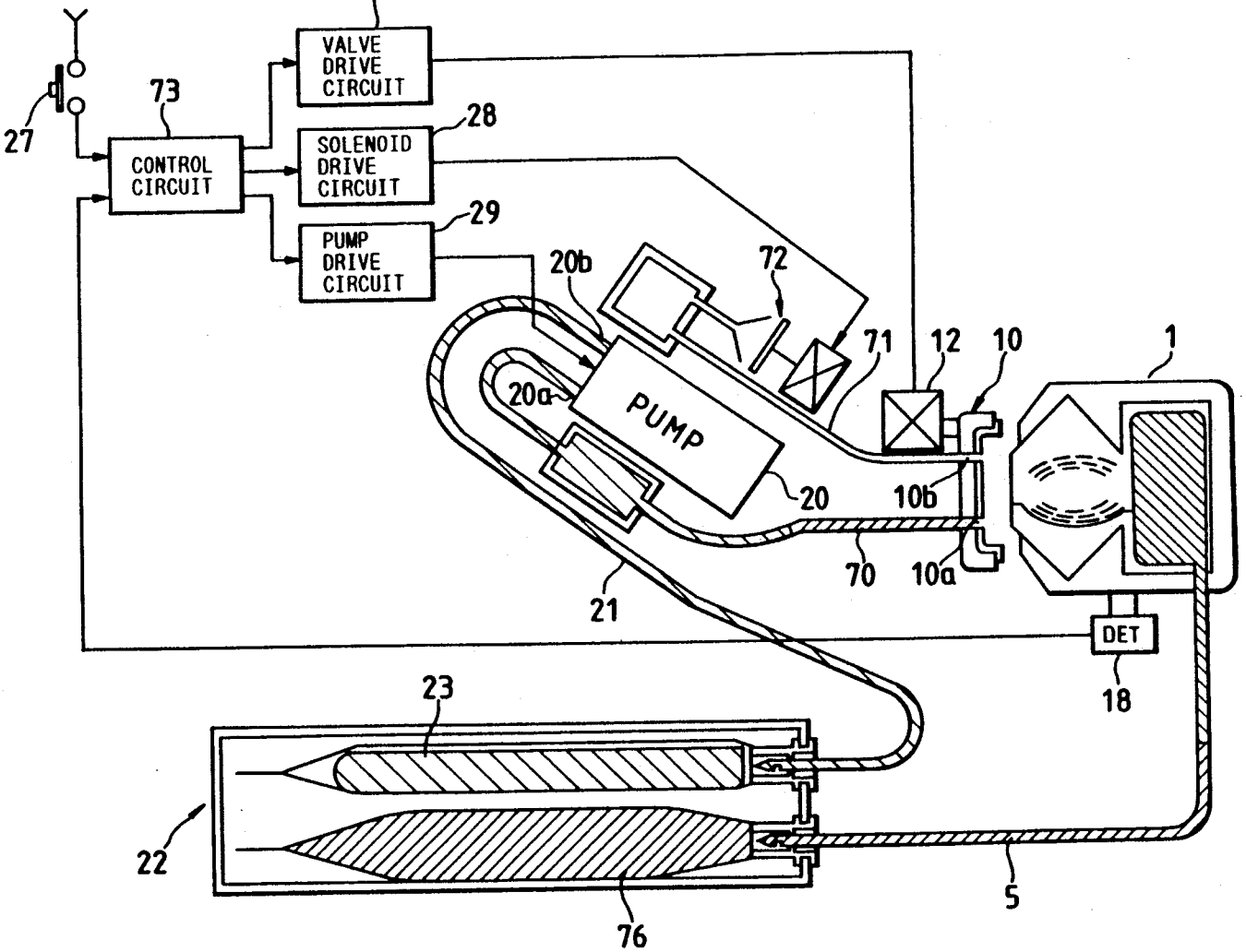
FIG. 16 is a block and schematic view showing an arrangement including ink flow paths and a control circuit according to a fifth embodiment of the present invention.

FIG. 16 shows a fifth embodiment of the present invention in the form of the cap member and its related structure. A suction pump 20 is coupled at the suction port 20*a* with a first through hole 10*a* of the cap member 10 by way of the tube 11, and at the discharge port 20*b* with a used-ink tank 23 of an ink cartridge 22 by way of a tube 70. An ink tank 24 contained in the cartridge 22 is connected to the print head 10 by way of a tube 5.

The cap member 10 is further provided with a second through hole 10*b*, and is coupled with an air open valve 72 by way of a tube 71.

Figure 17:
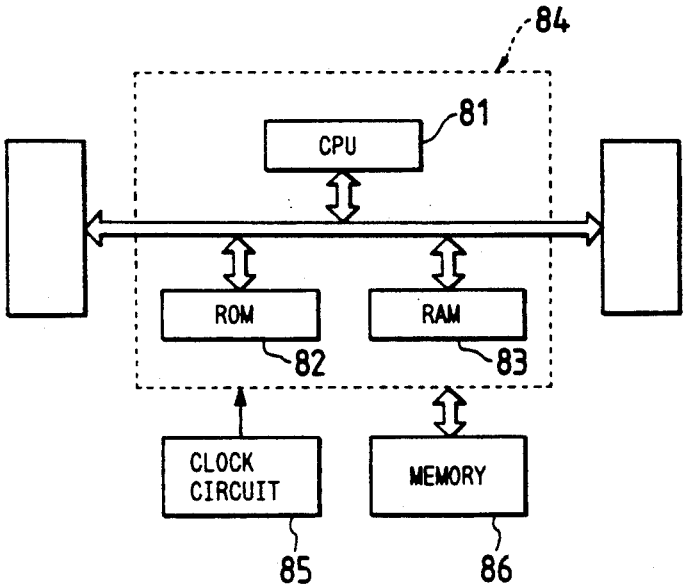
FIG. 17 is a block diagram showing the control circuit in the fifth embodiment.

A control circuit 73 is provided for executing a sequence of print recovery process steps, and is arranged as shown in FIG. 17. As shown, the control circuit 73 is composed of a microcomputer 84 including a CPU 81, a ROM 82 and a RAM 83, a clock circuit 85, and a memory 86 for storing time data representative of times of pushing of the recovery button 27. The microcomputer 84 is programmed so as to execute a sequence of operations as given below. When the recovery button 27, which is provided on an operating panel of the printer chassis, is pushed, the position detector 18 produces a signal. At this time, the control circuit sends a signal to the solenoid drive circuit 28 (FIG. 3). In turn, the drive circuit 28 drives the solenoid 12 to press the cap member 10 against the print head 1. Then, the control circuit sends a signal to the pump drive circuit 29 to operate the suction pump 20 for a preset time. Further, it sends a signal to the valve drive circuit 74, which intermittently opens and closes the air open valve 72 when a long suction time is completed.

Figure 18:
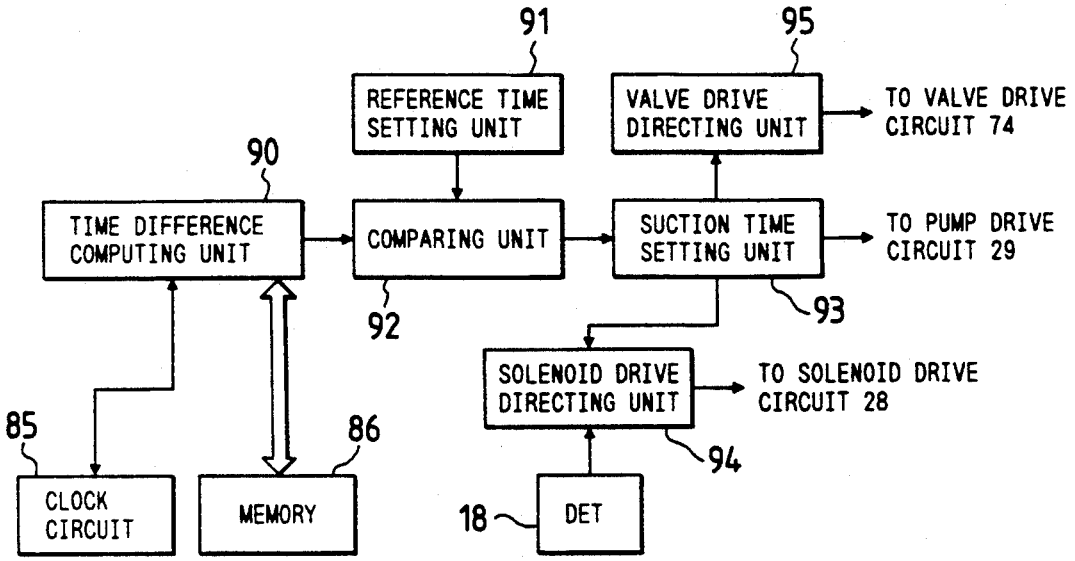
FIG. 18 is a block diagram showing the function of a microcomputer constituting the control circuit in the third embodiment.

FIG. 18 is a functional block diagram showing a model of the function to be realized by the microcomputer 84. The circuit is composed of time setting unit 91, comparing unit 92, suction time setting unit 93, solenoid drive unit 94, and valve drive directing unit 95. The time difference computing unit 90 computes a time difference $\Delta T$ between time data as stored in the memory 86 and the time of the present pushing of the recovery switch 27. The reference time setting unit 91 stores a reference time $T_O$ to determine a type of printing defect. The comparing unit 92 compares the time difference $\Delta T$ derived from the time difference computing unit 90 with the reference time $T_O$. The suction time setting unit 93 selects a suction time $T_S$ long enough to wash away paper particles and dust or a suction time $T_L$ long enough to remove air bubbles on the basis of the result of the comparison. The solenoid drive unit 94 energizes the solenoid 12 by a signal from the position detector 18, and de-energizes the same when the suction is completed. The valve drive directing unit 95 sends a signal to intermittently open and close the air open valve 72 when the suction of the suction time $T_L$ is completed, and the cap member 10 is separated from the print head 1.

Figure 19:
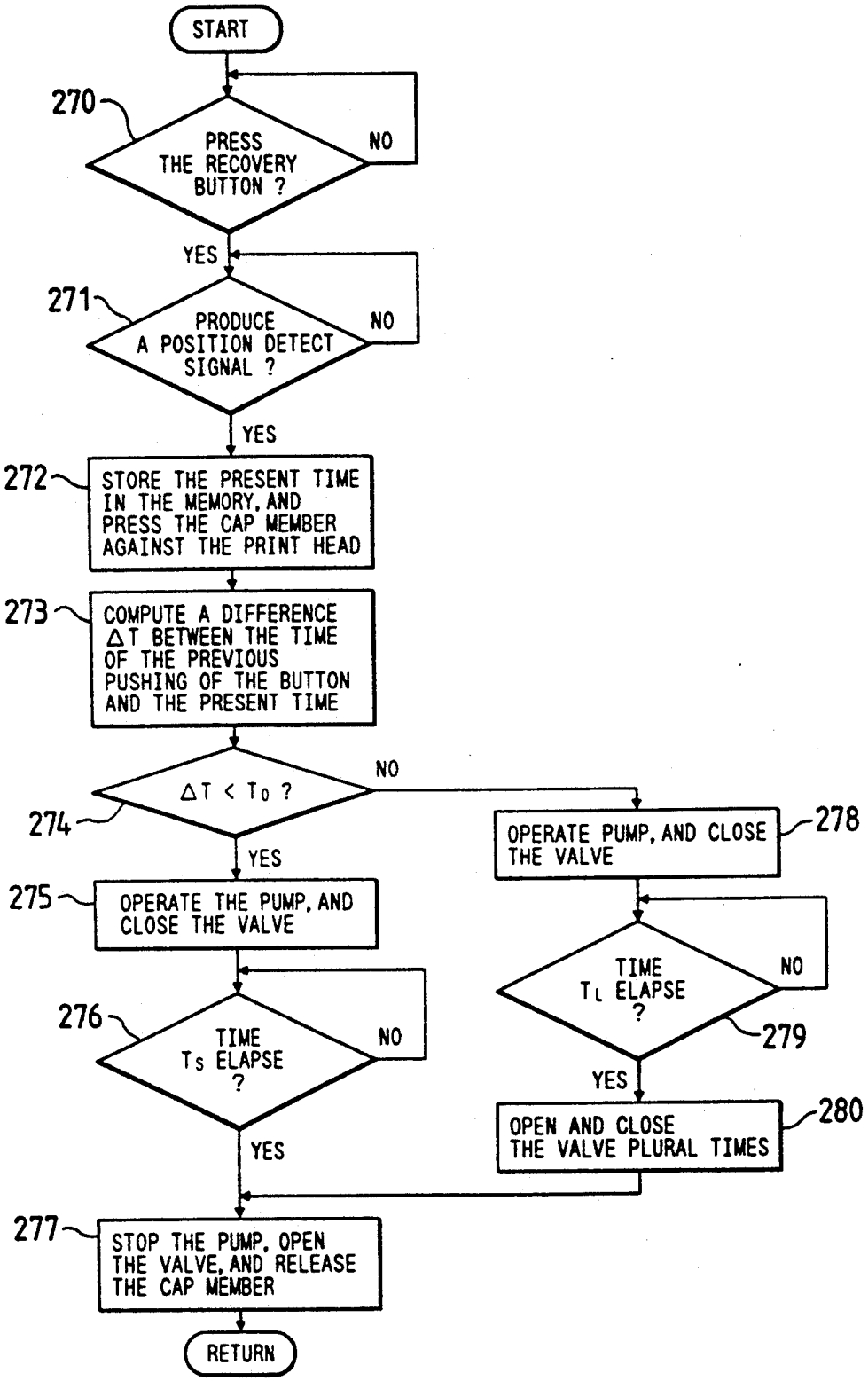
FIGS. 19 and 20 are a flow chart and a timing chart showing a sequence of operations of the apparatus shown in the fifth embodiment.
Figure 20:
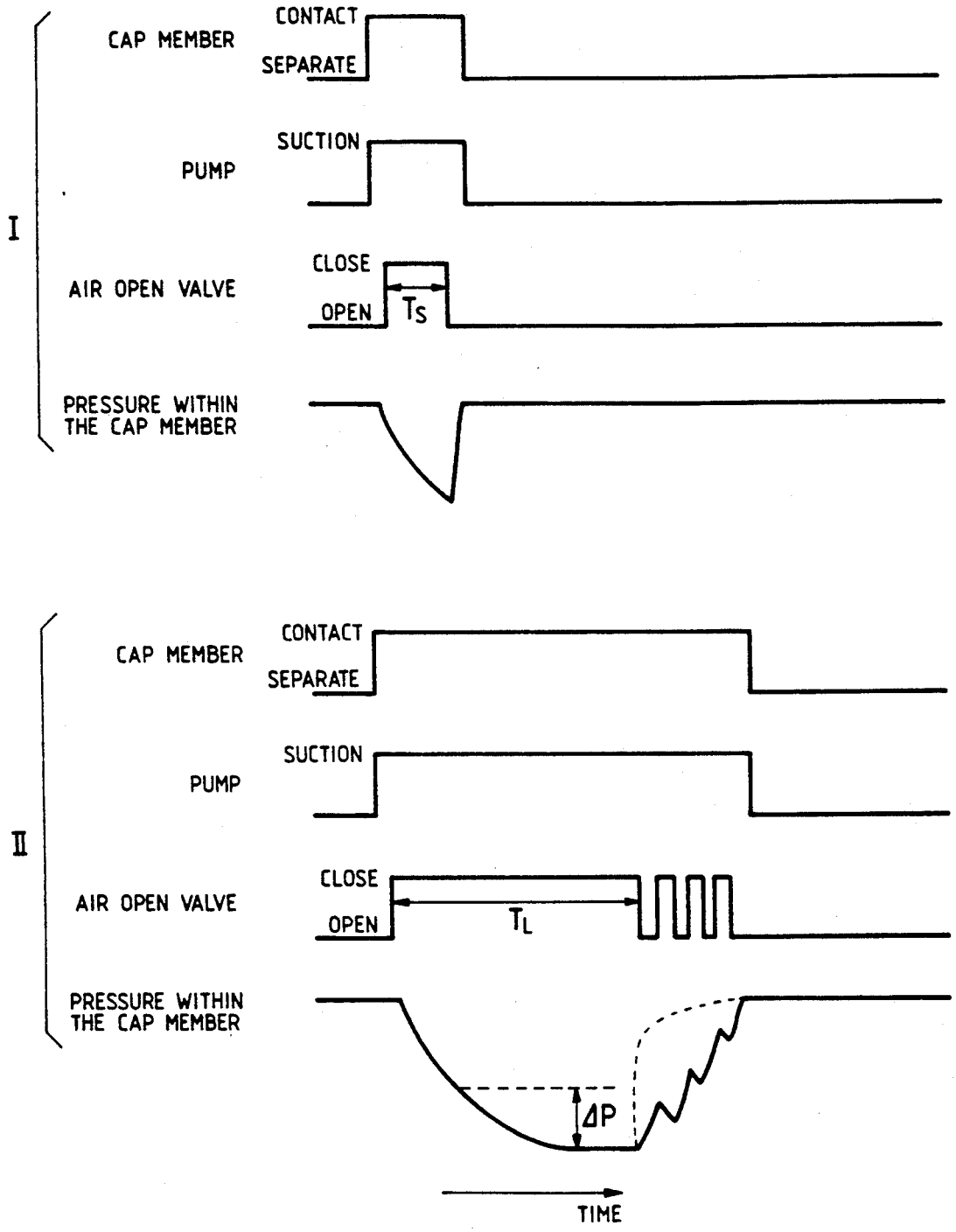

The operation of the apparatus thus arranged will be described with reference to FIGS. 19 and 20 respectively showing a flow chart and a timing chart.

When a printing defect is found, the user pushes the recovery button 27, which is provided on the chassis of the printer (step 270). Then, the carriage 4 is moved toward the cap member 10 under control of a carriage control circuit (not shown). The carriage 4 faces the cap member 10. At this time, the position detector 18 produces a signal (step 271). In response to the signal, the microcomputer 84 stores time data from the clock circuit 85 in the memory 86, and then sends a signal to the solenoid drive circuit 28 to energize the solenoid 12 (step 272). As a result, the cap member 10 hermetically closes the nozzle face 1*a* of the print head 1. The microcomputer 84 computes a time difference between time $t_1$ the button 27 generates a signal and time $t_0$ of the previous pushing of the button 27, viz., $\Delta T = t_1 - t_0$ (step 273). The present pushing of the button is the first pushing after power on. Accordingly, the CPU determines that the time difference $\Delta T$ is longer than the reference time $T_O$ (step 274). Then, the computer 84 issues a signal to the pump drive circuit 29, thereby to operate the suction pump 20, and then closes the air open valve 72, whereby a negative pressure is generated in the nozzle receiving chamber 17 of the cap member 10 (step 275). The negative pressure acts on the nozzle face 1*a* to extract ink through the nozzle openings. With the flow of the ink, paper particles and dust stuck to the nozzle openings are washed away. When time $T_S$, which is the time taken until the pump has sucked an amount of ink necessary for removing the foreign material, elapses (step 276), the microcomputer 84 stops the operation of the pump 20 and opens the valve 72, and at the same time de-energizes the solenoid 12 to separate the cap member 10 from the print head 1 (step 277). In the present case, since the suction time is short, the pressure in the cap member 10 is relatively high (FIG. 20, waveforms I). Accordingly, if the pump 20 is stopped, no impact will be applied to the meniscus of the nozzle.

A printing defect occurs again after a relatively short time of approximately ten and several minutes from the previous pushing of the button 27. After recognizing the printing defect, the user pushes the button 27 again (step 270). Then, the carriage 4 is moved and reaches the position of the cap member 10, and the position detector 18 produces a signal (step 271). At this time, the microcomputer 84 stores time data $l_2$ from the clock circuit 85 in the memory 86, and sends a signal to the solenoid drive circuit 28. As a result, the cap member 10 is pressed against the nozzle openings of the print head 1 (step 272). The microcomputer 84 computes a time difference between time $t_1$ of the previous ink suction as stored in the memory 86, and time $t_2$ of the present ink suction as stored in them memory 86, and time $t_2$ of the present ink suction, viz., $\Delta T = t_2 - t_1$ (step 273). Then, it compares the difference time with the reference time $T_O$ (step 274). The reference time $T_O$ is the time that elapses until the nozzles get clogged by foreign material, such as paper particles and dust, when the printer is operated in an ordinary printing mode, usually five to ten hours.

In the present case, the time difference $\Delta T$ $(=t_2 - t_1)$ is much shorter than the reference time $T_O$. This indicates a high probability that the cause of the present printing defect is not foreign material stuck to the nozzle openings, but air bubbles entering the ink path.

Accordingly, the computer 84 selects the suction time $T_L$ longer than the suction time $T_S$ necessary for removing the foreign material.

When the nozzle face 1*a* of the print head 1 is hermetically closed by the cap member 10, the computer operates the pump 20 and closes the valve 72 to apply a negative pressure to the nozzle receiving chamber 17 of the cap member 10 (step 278). Upon the negative pressure acting on the nozzle face 1*a*, ink is discharged from the ink flow path through the nozzle openings into the nozzle receiving chamber. Together with the discharged ink, the air bubbles are attracted toward the nozzle openings and discharged from the nozzles. At the instant that the time $T_L$ necessary for sucking ink of the amount of $Q_2$ necessary for discharging the bubbles elapses (step 279), the microcomputer 84 sends a signal to the valve drive circuit 74, thereby to open and close the valve 72 plural times (step 280). As a result, a pressure in the nozzle receiving chamber 17 of the cap member 10 gradually rises (FIG. 19, waveforms II). When the pressure peaks, the microcomputer 84 stops the operation of the pump 20, opens the valve 72, and separates separate the cap member 10 from the nozzle openings (step 277). The inner pressure within the cap member 10 which has gradually dropped, due to the long ink suction time, by pressure $\Delta P$ relative to the inner pressure at the time of paper particles removal, is gradually increased. Then, the pump 20 is stopped. Therefore, the suction operation can be stopped without applying an impact to the meniscus of the nozzle, and the next printing operation can be started reliably.

When the recovery button 27 is pushed five to ten hours from time point 52 of the previous pushing of the button 27 (step 270), as in the previous case, the carriage 4 retracts to the position of the cap member 10 and the position detector 18 produces a signal. At this time (step 271), the microcomputer 84 stores the time data $t_3$, which is received from the clock circuit 85, in the memory 86, and then sends a signal to the solenoid drive circuit 28. By the signal, the solenoid 12 is energized to make the cap member 10 contact with the print head 1 (step 272).

The microcomputer 84 computes a time difference between the time $t_2$ of the previous pushing of the recovery button 27 as stored in the memory 86 and time $t_3$ of the present pushing, $\Delta T = t_3 - t_2$ (Step 273). Then, it compares the time difference with the reference time $T_O$ (Step 274). In the present case, the time difference $\Delta T$ $(=t_3 - t_2)$ is longer than the reference time $T_O$, the microcomputer 84 selects the suction time $T_S$, so that the ink is sucked by the small ink amount $Q_S$ of the printing defect due to the foreign material (FIG. 20, waveforms I). Succeedingly, when the time $T_S$ elapses (step 276), the pump 20 is stopped, and the cap member 10 is opened (step 277). In this case, the time of operating the pump 20 is short, and hence the pressure in the cap member 10 is relatively high. Therefore, if the pump 20 is stopped, little adverse effects are placed on the meniscus of the nozzle.

Figure 21:
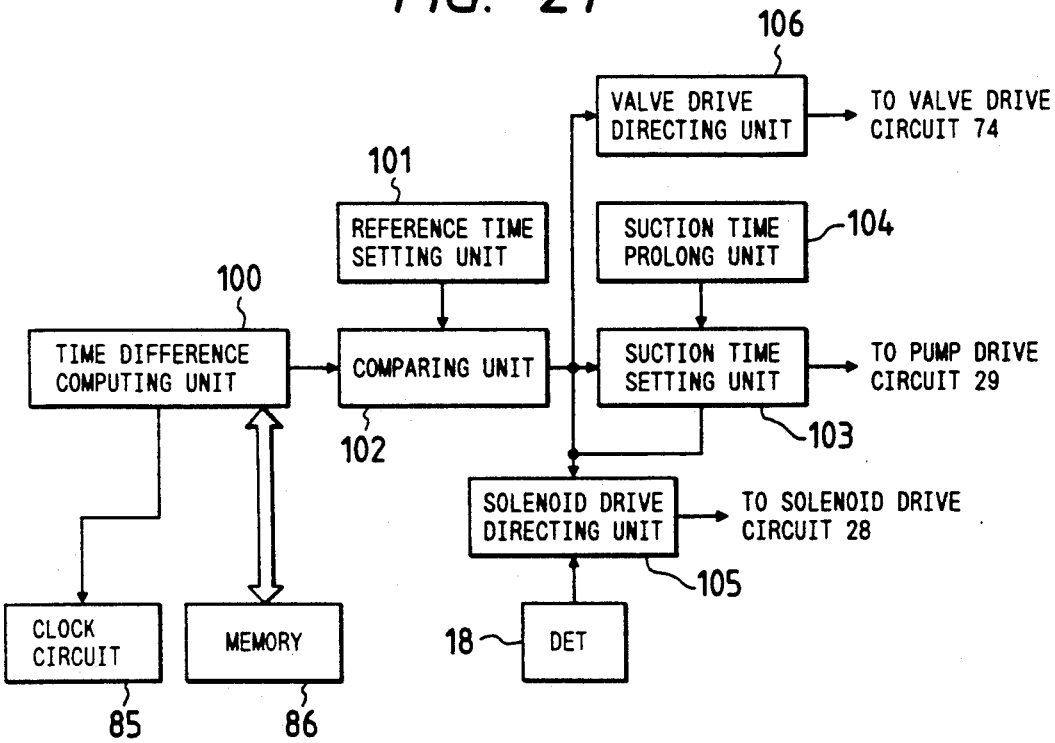
FIG. 21 is a block diagram showing the function to be executed by a microcomputer in a sixth embodiment of the present invention.

FIG. 21 shows a sixth embodiment in terms of the function to be realized by the microcomputer 84. The circuit is composed of time difference computing unit 100, reference time setting unit 101, comparing unit 102, suction time setting unit 103, suction time prolong unit 104, solenoid drive unit 105, and valve drive directing unit 106. The time difference computing unit 100 computes a time difference $\Delta T$ between the time data stored in the memory 86 and the time of the present pushing of the recovery switch 27. The reference time setting unit 101 stores a reference time $T_O$ to determine a type of printing defect. The comparing unit 102 compares the time difference $\Delta T$ derived from the time difference computing unit 100 with the reference time $T_O$. The suction time setting unit 103 selects a suction time $T_S$ long enough to remove air bubbles on the basis of the result of the comparison. When the recovery button 27 is pushed within the reference time $T_O$ after the completion of the suction time $T_L$, the suction time prolong unit 104 increments the suction time by fixed time $\Delta T_a$ every the N number of the pushings of the recovery button. The solenoid drive unit 105 energizes the solenoid 12 by a signal from the position detector 18, and de-energizes the same when the suction is completed. The valve drive directing unit 106 sends a signal to intermittently open and close the air open valve 72 when the suction of the suction time $T_L$ is completed, and the cap member 10 is separated from the print head 1.

Figure 22:
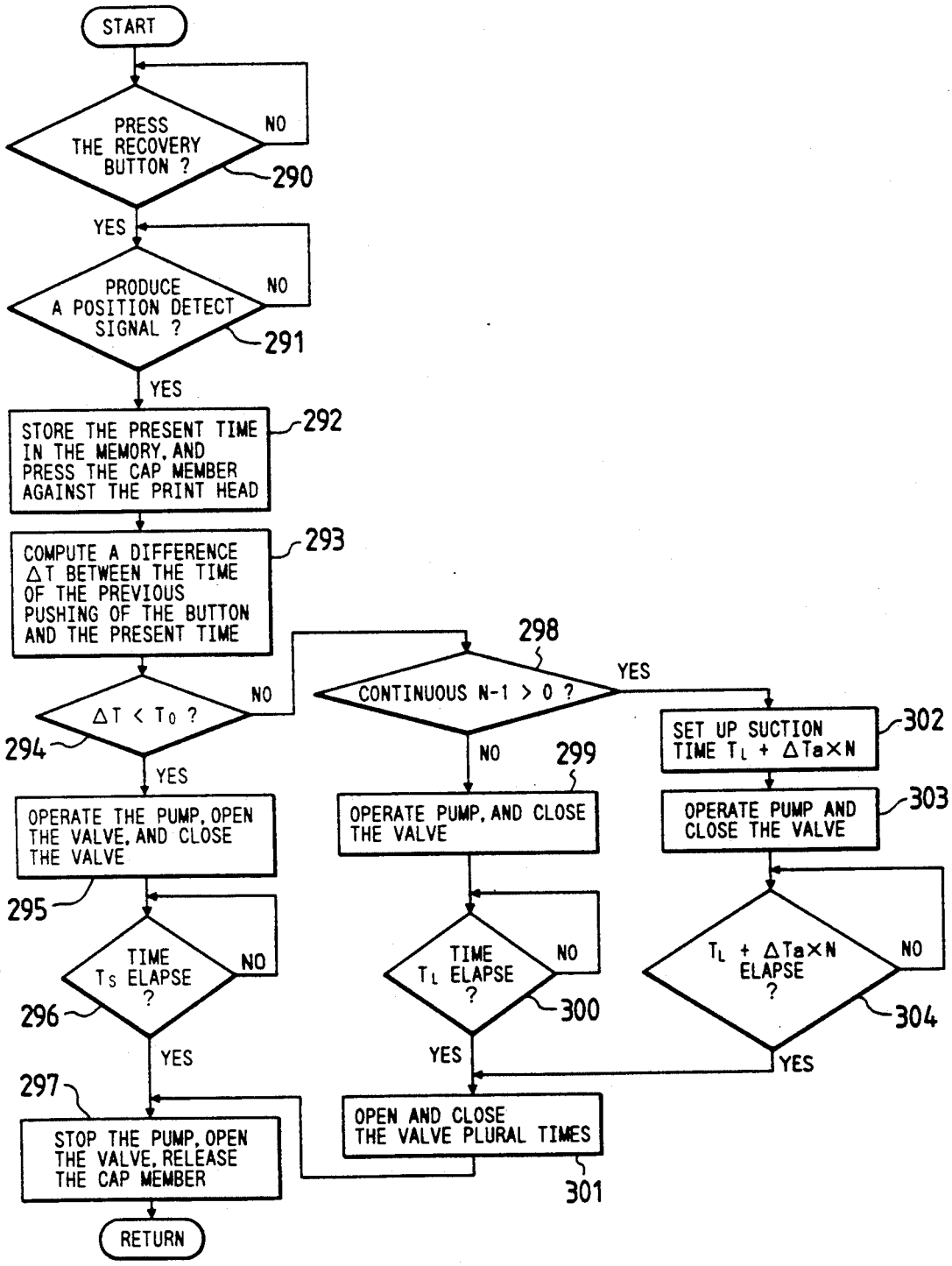
FIGS. 22 and 23 are a flow chart and a timing chart showing a sequence of operations of the apparatus shown in the sixth embodiment.
Figure 23:
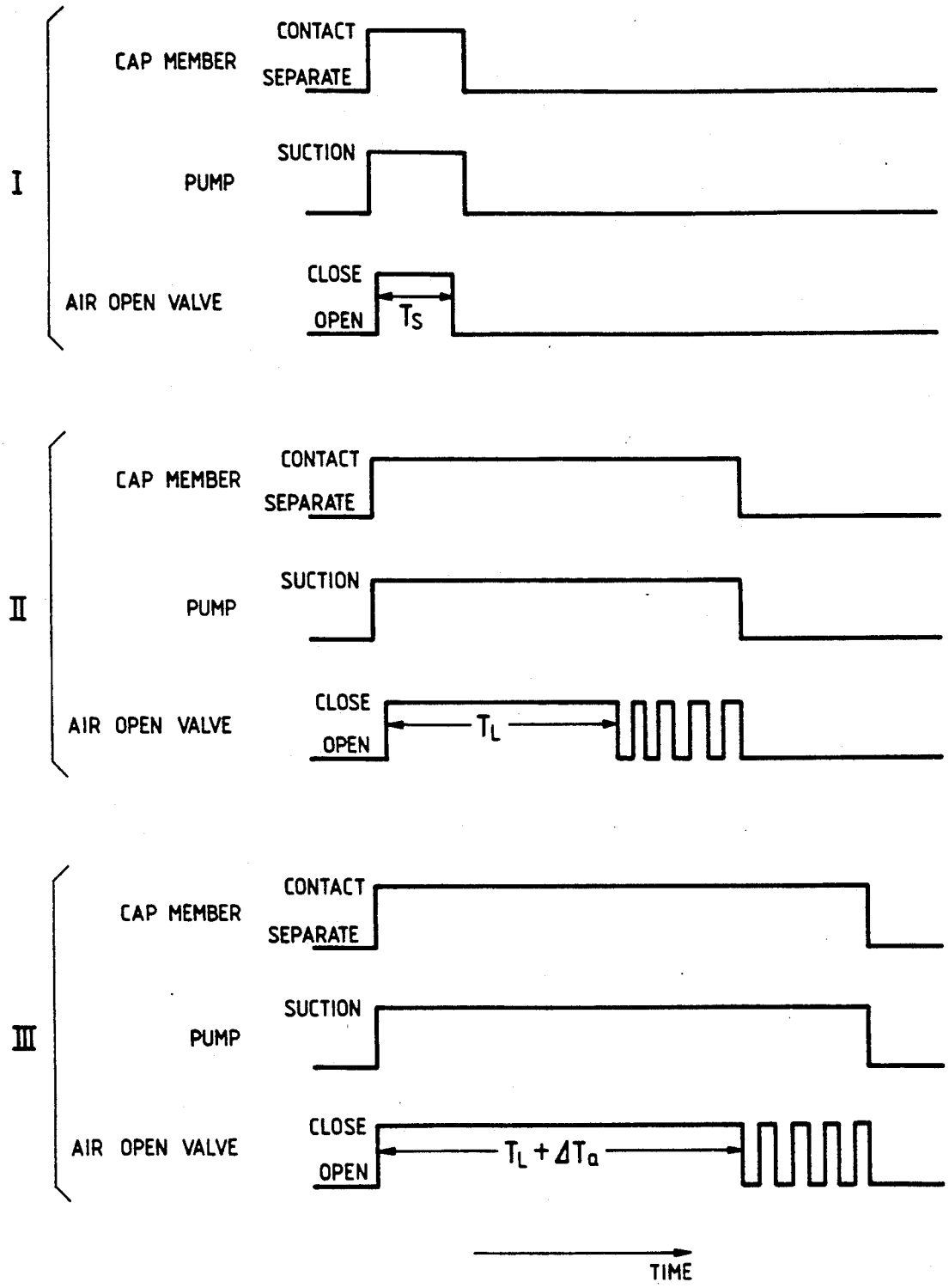

The operation of the apparatus thus arranged will be described with reference to FIGS. 22 and 23 respectively showing a flow chart and a timing chart.

When a printing defect is found, the user pushes the recovery button 27, which is provided on the chassis of the printer (step 290). Then, the carriage 4 is moved toward the cap member 10 under control of a carriage control circuit (not shown). The carriage 4 faces the cap member 10. At this time, the position detector 18 produces a signal (step 291). In response to the signal, the microcomputer 84 stores time data from the clock circuit 85 in the memory 86, and then sends a signal to the solenoid drive circuit 28 to energize the solenoid 12 (step 292). As a result, the cap member 10 hermetically closes the nozzle face 1a of the print head 1. The microcomputer 84 computes a time difference between time $t_1$ the button 27 generates a signal and time $t_0$ of the previous pushing of the button 27, viz., $\Delta T = t_1 - t_0$ (step 293). The present pushing of the button is the first pushing after power on. Accordingly, the CPU determines that the time difference $\Delta T$ is longer than the reference time $T_O$ (step 294). Then, the computer 84 issues a signal to the pump drive circuit 29, thereby to operate the suction pump 20, and then closes the air open valve 72, whereby a negative pressure is generated in the nozzle receiving chamber 17 of the cap member 10 (step 295). The negative pressure acts on the nozzle face 1a to extract ink through the nozzle openings. With the flow of the ink, paper particles and dust stuck to the nozzle openings are washed away. When time $T_S$, which is the time taken until the pump has sucked an amount of ink necessary for removing the foreign material, elapses (step 296), the microcomputer 84 stops the operation of the pump 20 and opens the valve 72, and at the same time de-energizes the solenoid 12 to separate the cap member 10 from the print head 1 (step 297). In the present case, since the suction time is short, the pressure in the cap member 10 is relatively high (FIG. 23, waveforms I). Accordingly, the print head 1 is operable within the print region, and starts to operate again.

A printing defect occurs again after a relatively short time of approximately ten and several minutes from the previous pushing of the button 27. After recognizing the printing defect, the user pushes the button 27 again (step 290). Then, the carriage 4 is moved and reaches the position of the cap member 10, and the position detector 18 produces a signal (step 291). At this time, the microcomputer 84 stores time data $l_2$ from the clock circuit 85 in the memory 86, and sends a signal to the solenoid drive circuit 28. As a result, the cap member 10 is pressed against the nozzle openings of the print head 1 (step 292). The microcomputer 84 computes a time difference between time $t_1$ of the previous ink suction as stored in the memory 86, and time $t_2$ of the present ink suction, viz., $\Delta T = t_2 - t_1$ (step 293). Then, it compares the difference time with the reference time $T_O$ (step 294).

In the present case, the time difference $\Delta T$ ($=t_2-t_1$) is much shorter than the reference time $T_O$. This indicates a high probability that the cause of the present printing defect is not foreign material stuck to the nozzle openings, but air bubbles entering into the ink path. Accordingly, the microcomputer 84 operates the pump 20 and energizes the valve 72, thereby to such the ink (step 299). After the time $T_L$ necessary for sucking ink in the amount of $Q_2$ necessary for discharging the bubbles (step 300), the microcomputer 84 intermittently sends an energizing signal to the valve drive circuit 74, thereby to open and close the valve 72 plural times. As a result, an internal pressure within the cap member 10 gradually rises. Then, the microcomputer 84 stops the operation of the pump 20, opens the valve 72, and separates the cap member 10 from the nozzle openings (step 297; FIG. 23, waveforms II).

When the previous ink suction operation for bubble removal incompletely removes the bubbles, another printing defect will occur within a very short period of time, e.g., after several minutes. At this time, if the recovery button 27 is pushed (step 290), the carriage 4 is moved toward the cap member 10. The position detector 18 produces a signal (step 291). At this time, the microcomputer 84 sends a signal to the solenoid drive circuit 28. By the signal, the solenoid 12 is energized to make the cap member 10 contact with the print head 1 (step 292). At the same time, the microcomputer 84 fetches time data $t_3$ from the clock circuit 85, and computes a time difference between the time $t_2$ of the previous pushing of the recovery button 27 as stored in the memory 86 and time $t_3$ of the present pushing, $\Delta T = t_3 - t_2$ (step 293). Then, it compares the time difference with the reference time $T_O$ (step 294). In the present case, the recovery button is pushed within the very short period of time. Therefore, the microcomputer 84 sets up the sum of the suction time $T_L$ for bubble removal and a preset increment $\Delta T_a$, $T_1 + \Delta T_a$ (step 302). Then, it operates the pump 20, and closes the valve 72 (step 303). After the sum $T_L + \Delta T_a$ (step 304), the microcomputer 84 opens and closes the valve 72 several times, to increase the pressure within the cap member 10 (step 301). Then, it stops the pump 20, opens the valve 72, and separates the print head 1 from the cap member 10 (step 297; FIG. 23, waveforms III).

Subsequently, when the pushing of the recovery button for the very short time is repeated, the suction time for the bubble removal is incremented by time $\Delta T \times N$ every N number of pushings to be $T_L+\Delta T\times N$ (step 302).

In the instant embodiment, even if the present defect found is a heavy printing defect requiring frequent pushings of the recovery button, it can be cured by incrementing the amount of the ink to be sucked. Further, the drop of the inner pressure of the cap member 10, which is caused by the long time suction, is relieved, thereby protecting the meniscus of the nozzles from the impact applied thereto. In this respect, reliable performance of the printer is ensured.

Figure 24:
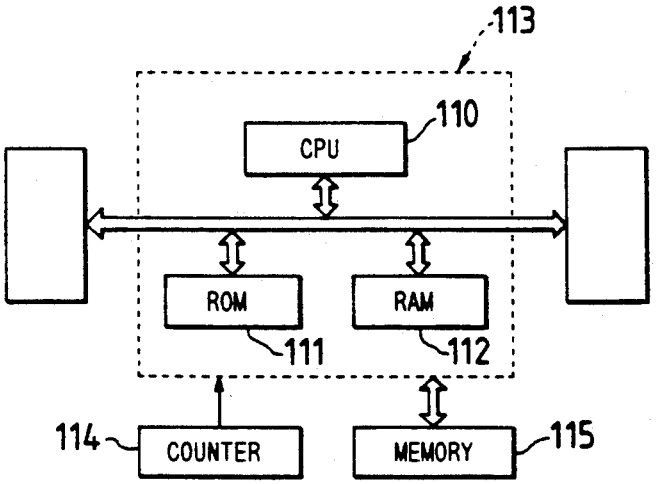
FIG. 24 is a block diagram showing a control circuit in a seventh embodiment.

FIG. 24 shows a seventh embodiment of the present invention in the form of an arrangement of the control circuit 26. As shown, the control circuit 26 is composed of a microcomputer 113 including a CPU 110, a ROM 111 and a RAM 112, a counter 114 for counting a print quantity, such as the number of printed characters, the number of lines, and an amount of paper feed, and a memory 115 for storing data of the counted print quantity derived from the counter 114 when the recovery button 27 is pushed. It is programmed so as to execute a sequence of operations as given below. When the recovery button 27, which is provided on an operating panel of the printer chassis, is pushed, the position detector 18 shown in FIG. 16 produces a signal. At this time, the control circuit sends a signal to the solenoid drive circuit 28. In turn, the drive circuit 28 drives the solenoid 12 to press the cap member 10 against the print head 1, and sends a signal to the pump drive circuit 29 to operate the suction pump 20 for a preset time. Further, it sends a signal to the valve drive circuit 74, which intermittently opens and closes the air open valve 72 when a long suction time is completed.

Figure 25:
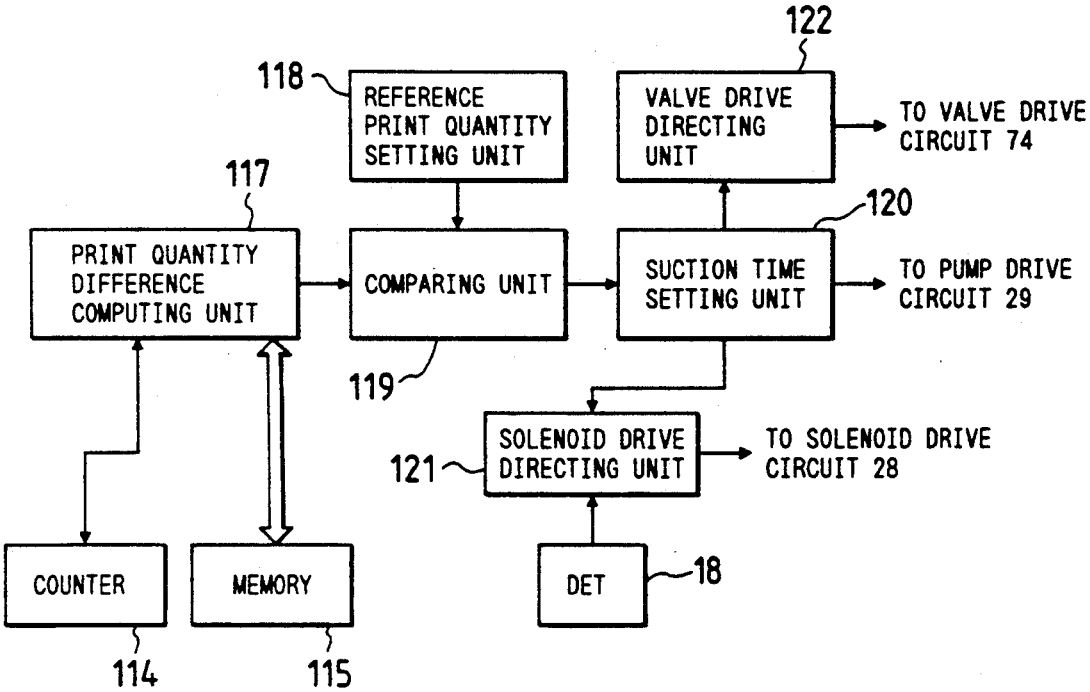
FIG. 25 is a block diagram showing the function to be executed by a microcomputer in the seventh embodiment of the present invention.

FIG. 25 is a functional block diagram showing a model of the function to be realized by the microcomputer 113. The circuit is composed of print quantity difference computing unit 117, reference print quantity setting unit 118, comparing unit 119, suction time setting unit 120, solenoid drive directing unit 121, and valve drive directing unit 122. The print quantity difference computing unit 117 computes a print quantity difference $\Delta L$ between print quantity data stored in the memory 115 and data output from the counter 114 when the recovery button 27 is pushed. The reference print quantity setting unit 118 stores a reference print quantity $L_O$ to determine a type of printing defect. The comparing unit 119 compares the print quantity difference data from the print quantity difference computing unit 117 with the reference print quantity $L_O$. The suction time setting unit 120 selects a suction time $T_S$ long enough to wash away paper particles and dust or a suction time $T_L$ long enough to remove air bubbles on the basis of the result of the comparison. The solenoid drive directing unit 121 energizes the solenoid 12 by a signal from the position detector 18, and de-energizes the same when the suction is completed. The valve drive directing unit 122 sends a signal to intermittently open and close the air open valve 72 when the suction of the suction time $T_L$ or more is completed, and the cap member 10 is separated from the print head 1.

Figure 26:
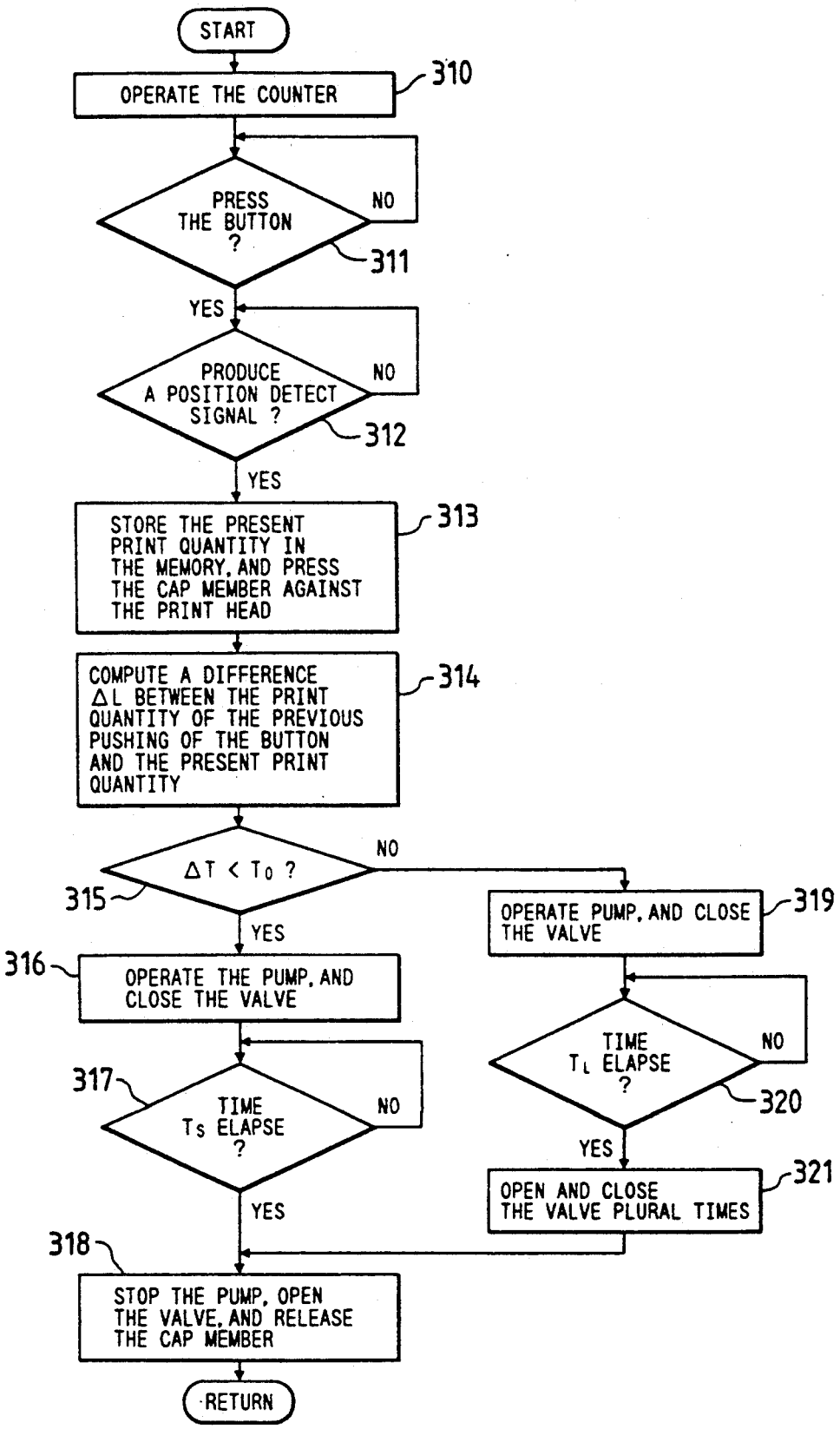
FIG. 26 is a flow chart showing an operation of the seventh embodiment.

The operation of the apparatus thus arranged will be described with reference to FIG. 26 showing a flow chart.

Upon start of a printing operation, the microcomputer 113 causes the counter 114 to count the print quantity (step 310). During the printing operation, if a printing defect is found, the user pushes the recovery button 27, which is provided on the chassis of the printer (step 311). Then, the carriage 4 is moved toward the cap member 10 under control of a carriage control circuit (not shown). The carriage 4 faces the cap member 10. At this time, the position detector 18 produces a signal (step 312). In response to the signal, the microcomputer 113 stores the print quantity $l_1$ of the counter 114 in the memory 115, and at the same time sends a signal to the solenoid drive circuit 28 to energize the solenoid 12. As a result, the cap member 10 hermetically closes the nozzle face 1*a* of the print head 1 (step 313). The microcomputer 113 fetches from the counter 114 the print quantity $l_1$ until the recovery button 27 produces a signal. Then, the microcomputer 113 computes a print quantity difference between the print quantity $l_1$ and a print quantity $l_0$ obtained in the previous pushing of the recovery button 27, viz., $\Delta L=l_1-l_0$ (step 314). The present pushing of the button is the first pushing after power on. Accordingly, the CPU determines that the print quantity difference $\Delta L$ is larger than the reference print quantity $L_O$ (step 315). Then, the computer 113 issues a signal to the pump drive circuit 29, thereby to operate the section pump 20, and then closes the valve 72, whereby a negative pressure is generated in the nozzle receiving chamber 17 of the cap member 10 (step 316). The negative pressure acts on the nozzle face 1*a* to extract ink through the nozzle openings. With the flow of the ink, paper particles and dust stuck to the nozzle openings are washed away. When time $T_S$, which is the time taken until the pump has sucked an amount of ink necessary for removing the foreign material, elapses (step 317), the microcomputer 113 stops the operation of the pump 20 and opens the valve 74, and at the same time de-energizes the solenoid 12 to separate the cap member 10 from the print head 1 (step 318). Under this condition, the print head 1 is operable in a print region and starts the printing operation again.

A printing defect occurs again after a relatively short time of ten and several lines from the previous pushing of the button 27. After recognizing the printing defect, the user pushes the button 27 again (step 311). Then, the carriage 4 is moved and reaches the position of the cap member 10, and the position detector 18 produces a signal (step 312). At this time, the microcomputer 113 stores print quantity data $l_2$ from the counter 114 in the memory 115, and sends a signal to the solenoid drive circuit 28. As a result, the cap member 10 is pressed against the nozzle openings of the print head 1 (step 313). The microcomputer 113 computes a print quantity difference between the print quantity data $l_2$ and the previous print quantity $l_1$ stored in the memory 115, viz., $\Delta L=l_2-l_1$ (step 314). Then, it compares the difference print quantity with the reference print quantity $L_O$ (step 315). The microcomputer 113 selects the suction time $T_L$, which is longer than the suction time $T_S$ for removing the paper particles and dust (step 319).

When the nozzle face 1*a* of the print head 1 is hermetically closed by the cap member 10, the computer operates the pump 20 and closes the valve 72, to apply a negative pressure to the nozzle receiving chamber 17 of the cap member 10 (step 319). Upon the negative pressure acting on the nozzle face 1*a*, ink is discharged from the ink flow path through the nozzle openings into the nozzle receiving chamber. Together with the discharged ink, the air bubbles are attracted toward the nozzle openings and discharged outside from the nozzles. At the instant that the time $T_L$ necessary for sucking ink in the amount of $Q_2$ necessary for discharging the bubbles elapses (step 320), the microcomputer 84 sends a signal to the valve drive circuit 74, thereby to open and close the valve 72 plural times (step 321). As a result, a pressure in the nozzle receiving chamber 17 of the cap member 10 gradually rises (step 321). Then, the microcomputer 84 stops the operation of the pump 20, opens the valve 72, de-energizes the solenoid 12, and separates the cap member 10 from the nozzle openings (step 318). Under this condition, the carriage 4 is movable within the print region (step 318).

When the recovery button 27 is pushed after the print of 250 to 1,000 lines is made further to the quantity $L_1$ of the print made by the previous pushing of the button 27 (step 311), the carriage 4 retracts to the position of the cap member 10 and the position detector 18 produces a signal. At this time (step 312), the microcomputer 113 stores the print quantity data 13 of the counter 114 in the memory 115, and then sends a signal to the solenoid drive circuit 28. By the signal, the solenoid 12 is energized to make the cap member 10 contact with the print head 1 (step 313).

The microcomputer 113 computes a print quantity difference between the print quantity $l_2$ of the previous pushing of the recovery button 27 as stored in the memory 115 and print quantity $l_3$ of the present pushing, $\Delta L = l_3 - l_2$ (step 315). Then, it compares the print quantity difference with the reference print quantity $L_O$ (step 315). In the present case, the print quantity difference $\Delta L$ $(=l_3 - l_2)$ is larger than the reference print quantity $L_O$, the microcomputer 113 selects the suction print quantity $Q_S$, so that the ink is sucked by the small ink amount $Q_S$ for removing the printing defect due to the clogging of the nozzles by paper particles and dust. Succeedingly, the steps (316) to (318) are executed. As a consequence, foreign material, such as paper particles and dust, is washed away from the nozzle openings with the discharged ink, and the printer is placed to be ready for printing.

Figure 27:
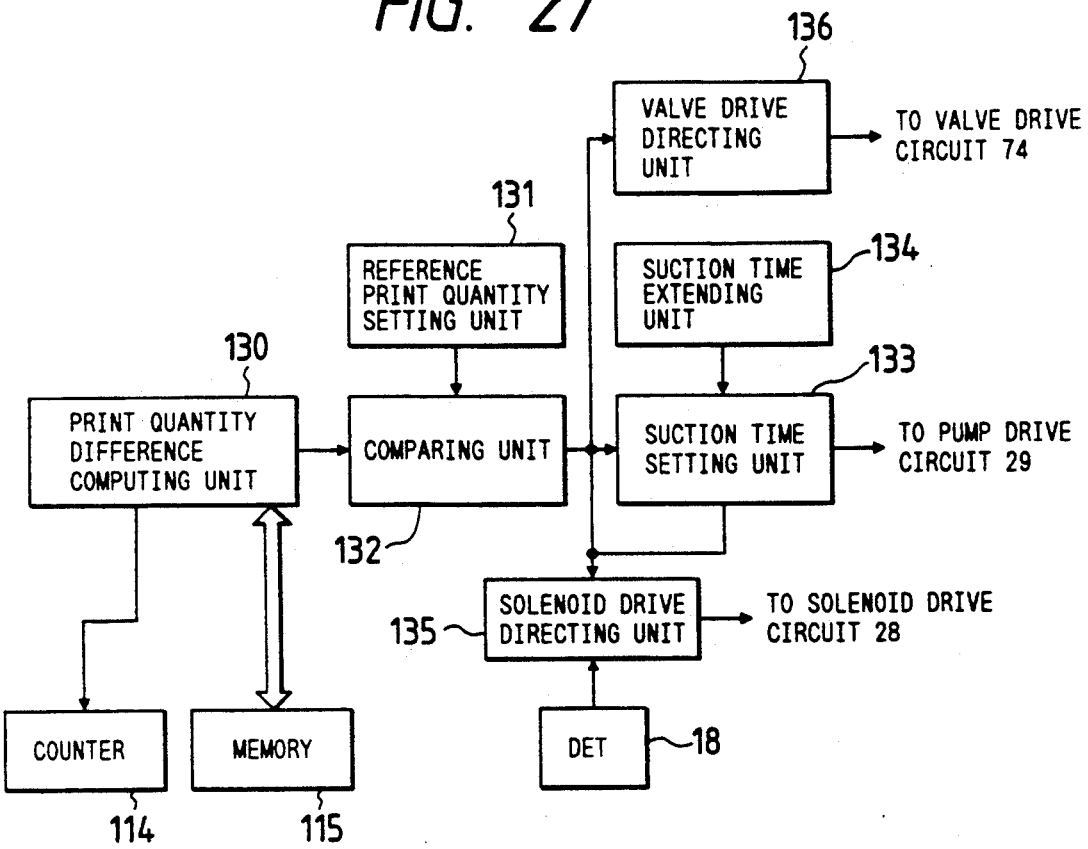
FIG. 27 is a block diagram showing the function to be executed by a microcomputer in an eight embodiment of the present invention.

FIG. 27 shows an eighth embodiment in the form of the function to be realized by the microcomputer. The circuit is composed of print quantity difference computing unit 130, reference print quantity setting unit 131, comparing unit 132, suction time setting unit 133, suction time extending unit 134, solenoid drive directing unit 135, and valve drive directing unit 136. The print quantity difference computing unit 130 computes a print quantity difference $\Delta L$ between print quantity data stored in the memory 115 and data output from the counter 114 when the recovery button 27 is pushed. The reference print quantity setting unit 131 stores a reference print quantity $L_O$ to determine the type of printing defect. The comparing unit 132 compares the print quantity difference data from the print quantity difference computing unit 130 with the reference print quantity $L_O$. The suction time setting unit 133 selects a suction time $T_S$ long enough to wash away paper particles and dust or a suction time $T_L$ long enough to remove air bubbles on the basis of the result of the comparison. When the recovery button 27 is pushed within the reference print quantity $L_O$ after the completion of the suction for the suction time $T_L$, the suction time extending unit 136 increments the suction time by fixed time $\Delta T_a$ every the N number of pushings of the recovery button. The solenoid drive unit 135 energizes the solenoid 12 by a signal from the position detector 18, and de-energizes the same when the suction is completed. The valve drive directing unit 136 sends a signal to intermittently open and close the air open valve 72 when the suction of the suction time $T_L$ or more is completed, and the cap member 10 is separated from the print head 1.

Figure 28:
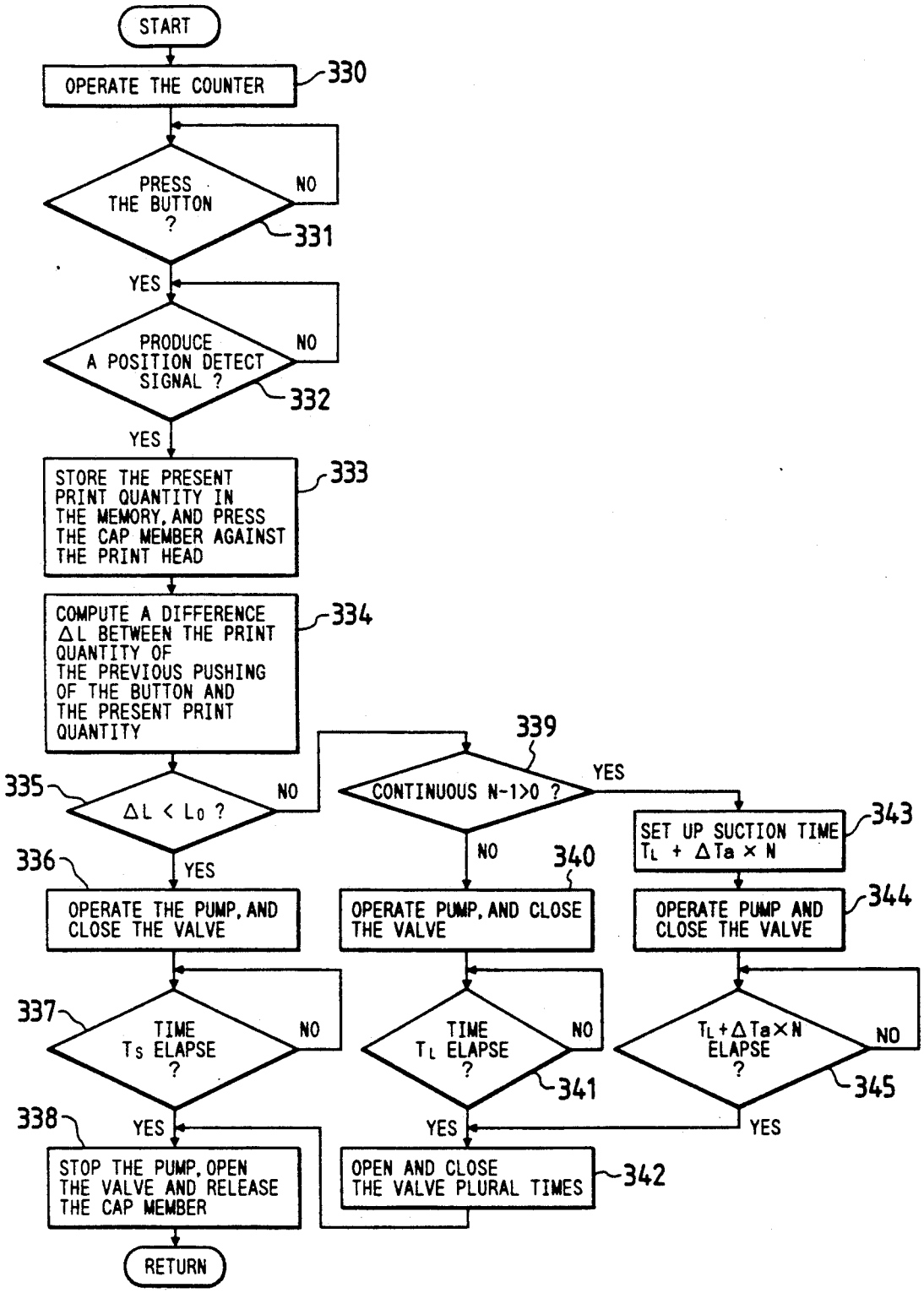
FIG. 28 is a flow chart showing an operation of the eight embodiment.

The operation of the apparatus thus arranged will be described with reference to FIG. 28 showing a flow chart.

Upon starting of a printing operation, the microcomputer 113 causes the counter 114 to count the print quantity (step 330). During the printing operation, if a printing defect is found, the user pushes the recovery button 27, which is provided on the chassis of the printer (step 331). Then, the carriage 4 is moved toward the cap member 10 under control of a carriage control circuit (not shown). The carriage 4 faces the cap member 10 At this time, the position detector 18 produces a signal (step 332). In response to the signal, the microcomputer 113 fetches from the counter 114 the print quantity $l_1$ at the instant that the recovery button 27 generates a signal, and stores the print quantity $l_1$ of the counter 114 in the memory 115, and at the same time sends a signal to the solenoid drive circuit 28 to energize the solenoid 12. As a result, the cap member 10 hermetically closes the nozzle face 1*a* of the print head 1 (step 333). The microcomputer 113 fetches from the computer 114 the print quantity $l_1$ until the recovery button 27 produces a signal. Then, the microcomputer 113 computes a print quantity difference between the print quantity $l_1$ and a print quantity 10 obtained in the previous pushing of the recovery button 27, viz., $\Delta L = l_1 - l_0$ (step 334), and compares the different print quantity with the reference print quantity $L_O$ (step 335). Then, the computer 113 issues a signal to the pump drive circuit 29, thereby to operate the suction pump 20, and then closes the valve 72, whereby a negative pressure is generated in the nozzle receiving chamber 17 of the cap member 10 (step 336). The negative pressure acts on the nozzle face 1*a* to extract ink through the nozzle openings. With the flow of the ink, paper particles and dust stuck to the nozzle openings are washed away. When time $T_S$, which is the time taken until the pump has sucked an amount of ink necessary for removing the foreign material, elapses (step 337), the microcomputer 113 stops the operation of the pump 20 and opens the valve 74, and at the same time de-energizes the solenoid 12 to separate the cap member 10 from the print head 1 (step 338). Under this condition, the print head 1 is operable in a print region and starts the printing operation again.

A printing defect occurs again after a relatively short time of several tens lines from the previous pushing of the button 27. After recognizing the printing defect, the user pushes the button 27 again (step 331). Then, the carriage 4 is moved and reaches the position of the cap member 10, and the position detector 18 produces a signal (step 332). At this time, the microcomputer 113 stores print quantity data $l_2$ from the counter 114 in the memory 57, and sends a signal to the solenoid drive circuit 28. As a result, the cap member 10 is pressed against the nozzle openings of the print head 1 (step 333). The microcomputer 113 computes a print quantity difference between the print quantity data $l_2$ and the print quantity $l_1$ at the time of the previous ink suction, viz., $\Delta L = l_2 - l_1$ (step 334). Then, it compares the difference print quantity with the reference print quantity $L_O$ (step 335).

When the nozzle face 1*a* of the print head 1 is hermetically closed by the cap member 10, the computer operates the pump 20 and closes the valve 72, to apply a negative pressure to the nozzle receiving chamber 17 of the cap member 10 (step 339). Upon the negative pressure acting on the nozzle face 1*a*, ink is discharged from the ink flow path through the nozzle openings into the nozzle receiving chamber. Together with the discharged ink, the air bubbles are attracted toward the nozzle openings and discharged outside from the nozzles. At the instant that the time $T_L$ necessary for sucking ink of the amount of $Q_2$ necessary for discharging the bubbles elapses (step 320), the microcomputer 84 sends a signal to the valve drive circuit 74, thereby to open and close the valve 72 plural times (step 321). As a result, a pressure in the nozzle receiving chamber 17 of the cap member 10 gradually rises (step 321). Then, the microcomputer 84 stops the operation of the pump 20, opens the valve 72, de-energizes the solenoid 12, and separates the cap member 10 from the nozzle openings (step 338). Under this condition, the carriage 4 is movable within the print region (step 338) and the print operation starts again.

When the recovery button 27 is pushed again, with a small print quantity of several tens after the previous pushing of the button 27 (step 331), the carriage 4 retracts to the position of the cap member 10 and the position detector 18 produces a signal. At this time (step 332), the microcomputer 113 stores the print quantity data $l_2$ of the counter 114 in the memory 115, and then sends a signal to the solenoid drive circuit 28. By the signal, the solenoid 12 is energized to make the cap member 10 contact with the print head 1 (step 333). Succeedingly, the microcomputer computes a print quantity difference $\Delta L = l_2 - l_1$ between the print quantity of the present ink suction and that $l_1$ of the previous ink suction (step 334), and compares it with the reference print quantity $L_O$ (step 335).

In the case now discussed, the print quantity difference $\Delta L$ $(=l_2 - l_1)$ is much smaller than the reference print quantity $L_O$. This indicates a high probability that the printing defect is due to air bubbles mixing in the ink flow path, not foreign materials stuck to the nozzle openings. Accordingly, the microcomputer 113 operates the pump 20 and closes the valve 72 and increases the inner pressure in the cap member 10 (step 342), and it stops the pump 20, opens the valve 72, and separates the cap member 10 from the print head 1 (step 338).

In the case where the previous ink suction operation for the bubble removal imperfectly removed the air bubbles, the printing defect due to the air bubbles will occur again within a very short time, e.g., several lines to ten and several lines. If such printing defect occurs and the user pushes the recovery button 27 (step 331), the carriage 4 is moved to the position of the cap member 10 and the position detector 18 produces an output signal (step 332). At this time, the microcomputer 33 stores the print quantity $l_3$ of the counter 114 in the memory 115, and sends a signal to the solenoid drive circuit 28. Then, the cap member 10 is pressed against the nozzle openings of the print head 1 (step 333). At the same time, the microcomputer 33 computes a time difference between the print quantity $l_3$ and the previous print quantity $l_2$ stored in the memory 115, viz., $\Delta L = l_3 - l_2$ (step 334). Then, it compares the difference time with the reference print quantity $L_O$ (step 335). In the case now discussed, the recovery button is operated again within a very short time (steps 335, 339), the microcomputer 33 increments the suction time $T_L$ for the bubble removal by a preset time $\Delta T_A$ to be $T_L + \Delta T_a$ (step 343), and operates the pump 20 and closes the valve 72 (step 433). After the incremented suction time $T_L + \Delta T_a$ elapses (step 345), the microcomputer opens the valve 72 plural times (step 342). When the inner pressure in the cap member 72 has been increased, the microcomputer stops, opens the valve 72, and separates the cap member 10 from the print head 1 (step 338).

Subsequently, when the pushing of the recovery button for the very short time is repeated, the suction time for the bubble removal is incremented by time $\Delta T \times N$ every N number of pushings to be $T_l + \Delta T \times N$ (step 262).

Accordingly, even if the print found is a heavy printing defect requiring frequent pushings of the recovery button, it can be cured by incrementing the amount of the ink to be sucked. Further, in the instant embodiment, the pressure within the cap member, which has been considerably reduced as the result of a long time of operation of the pump, is gradually increased up to atmospheric pressure. This feature allows the cap member to be removed without disturbing the meniscus of the nozzles.

Another ink jet printer of the type in which paper particles and dust are washed away with ink and further wiped up with a brush will now be described.

Figure 29:
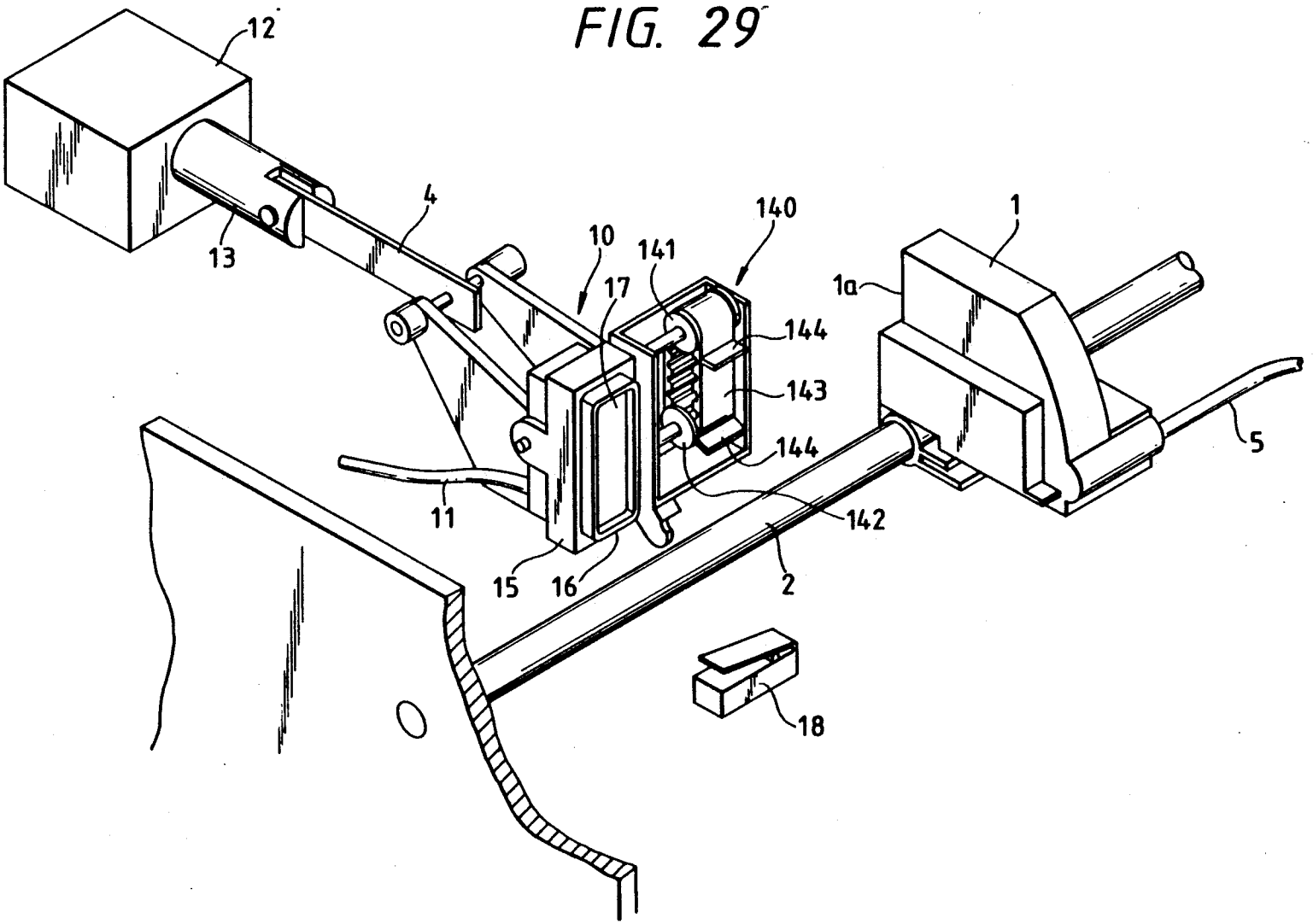
FIG. 29 is a perspective view showing in detail a cap member of a ninth embodiment of the present invention and a structure around the cap member.

FIG. 29 is a perspective view showing a ninth embodiment of the present invention in the form of a structure including a cap member and its related structure, which is suitable for curing printing defects caused by such a brush. In this figure, reference numeral 140 designates a brush mechanism which is located outside the print region, or adjacent to the cap member 10, in this instance. In the brush mechanism 140, a belt 143, with linear members as brushes 144 and 144 fixed thereto, is strained between paired rollers 141 and 142, which are driven by a drive mechanism (not shown). In operation, the tips of the brushes 144 and 144 contact the nozzle openings of the print head 1 to thus wipe the nozzle openings and the portion in the vicinity thereof.

Figure 30:
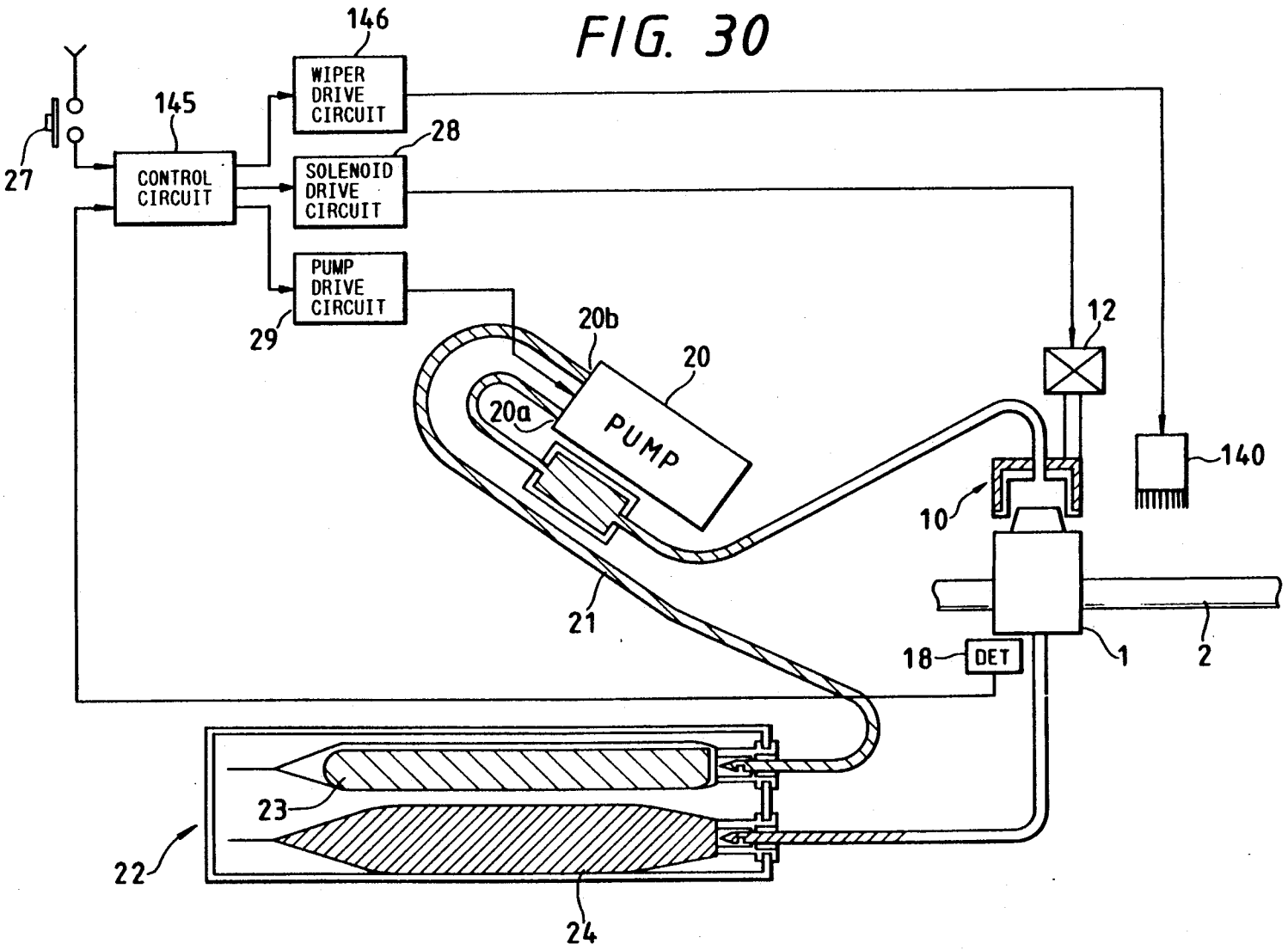
FIG. 30 is a block and schematic view showing an arrangement including ink flow paths and a control circuit according to the ninth embodiment shown in FIG. 9.

FIG. 30 is a block and schematic diagram showing the arrangement of a printer containing an ink supply flow system, an ink suction flow system operating in a print recovery mode, and a control system for print recovery. In the figure, the brush mechanism 140 is driven by a wiper drive circuit 145, which receives a signal from a control circuit 145 (described in more detail below). A suction pump 20, constructed as already described referring to FIG. 2, is coupled at the suction port 20*a* via a first through hole 10*a* of the cap member 10 by way of the tube 70, and at the discharge port 20*b* with a used-ink tank 23 of an ink cartridge 22 by way of a tube 70. An ink tank 24 contained in the cartridge 22 is connected for ink supply to the print head 10 via a tube 5.

The cap member 10 is moved to and retracted from the front face 1*a* of the print head 1 by the solenoid 12, which is driven by a signal from the solenoid drive circuit 28.

Figure 31:
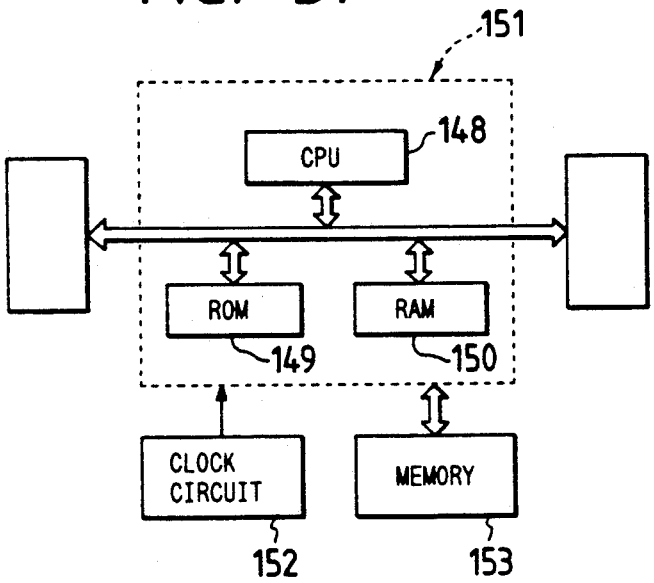
FIG. 31 is a block diagram showing a control circuit constituting the ninth embodiment.

FIG. 31 shows an embodiment of the control circuit for executing a sequence of print recovery process steps, which is arranged as shown in FIG. 4. As shown, the control circuit 26 is composed of a microcomputer 151 including a CPU 148, a ROM 149 and a RAM 150, a clock circuit 152, and a memory 153 for storing time data representative of the time of pushing of the recovery button 27. The control circuit 26 is programmed so as to execute a sequence of operations as given below. When the recovery button 27, which is provided on an operating panel of the printer chassis, is pushed, the position detector 18 produces a signal. At this time, the control circuit sends a signal to the solenoid drive circuit 28 (FIG. 3). In turn, the drive circuit 28 drives the solenoid 12 to press the cap member 10 against the print head 1. Then, the control circuit sends a signal to the pump drive circuit 29 to operate the suction pump 20 for a preset time.

Figure 32:
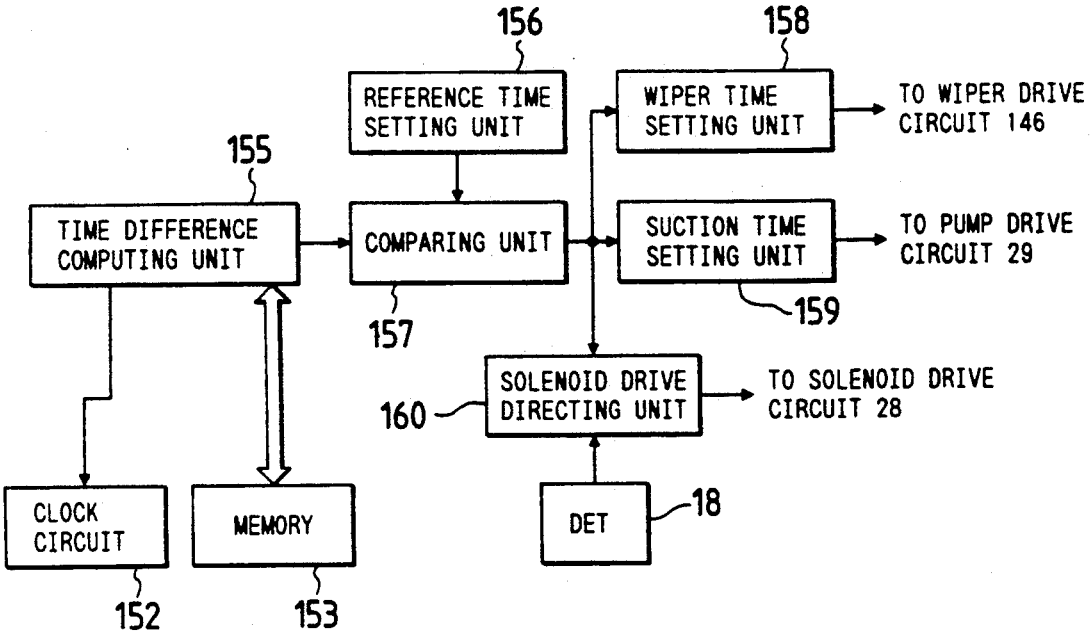
FIG. 32 is a block diagram showing the function of a microcomputer constituting the control circuit in the ninth embodiment of FIG. 31.

FIG. 32 is a functional block diagram showing the functions to be realized by the microcomputer 151. The circuit is composed of a time difference computing unit 155, reference time setting unit 156, comparing unit 157, wiping time setting unit 158, suction time setting unit 159, and solenoid drive directing unit 160. The time difference computing unit 155 computes a time difference $\Delta T$ between time data stored in the memory 153 and time data generated from the clock circuit 152 when the recovery button 27 is pushed. The reference time setting unit 156 stores a reference time $T_O$ to determine a type of printing defect. The comparing unit 157 the time difference $\Delta T$ derived from the time difference computing unit 155 with the reference time $T_O$. The wiping time setting unit 158 sets a brush mechanism drive time $T_d$ necessary for removing paper particles and dust, on the basis of the comparison result. The suction time setting unit 159 selects an ink suction time $T_c$ after the wiping or a suction time $T_L$ long enough to remove air bubbles. In response to the position detector 18, the solenoid drive directing unit 160 generates a signal that moves the print head 1 toward the brush mechanism 140 or the cap member 10, and such that when the print head 1 is positioned in front of the cap member 10, it energizes the solenoid 12 or deenergizes the same when the suction is completed.

Figure 33:
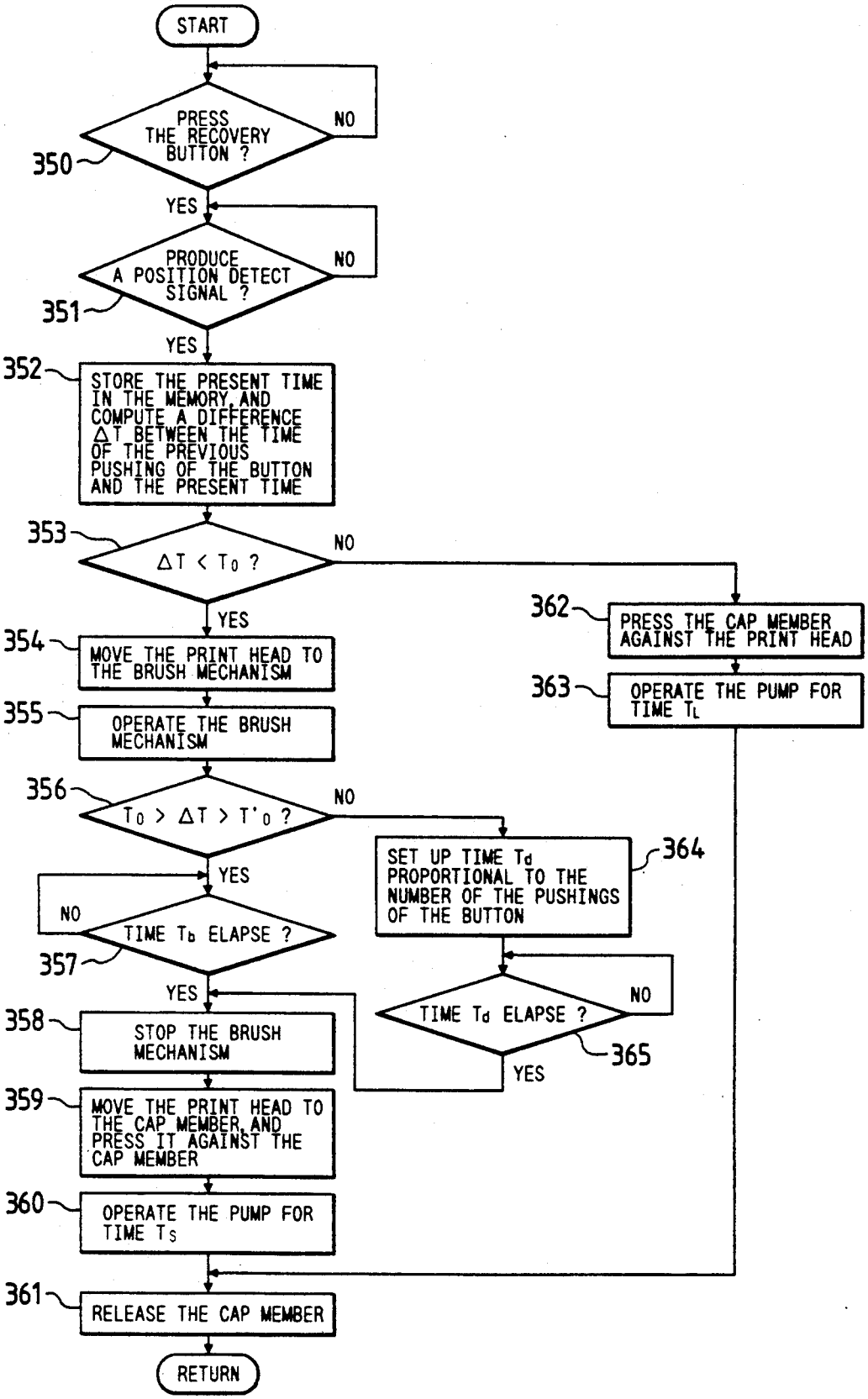
FIGS. 33 and 34 are a flow chart and a timing chart showing a sequence of operations of the apparatus shown in the ninth embodiment.
Figure 34:
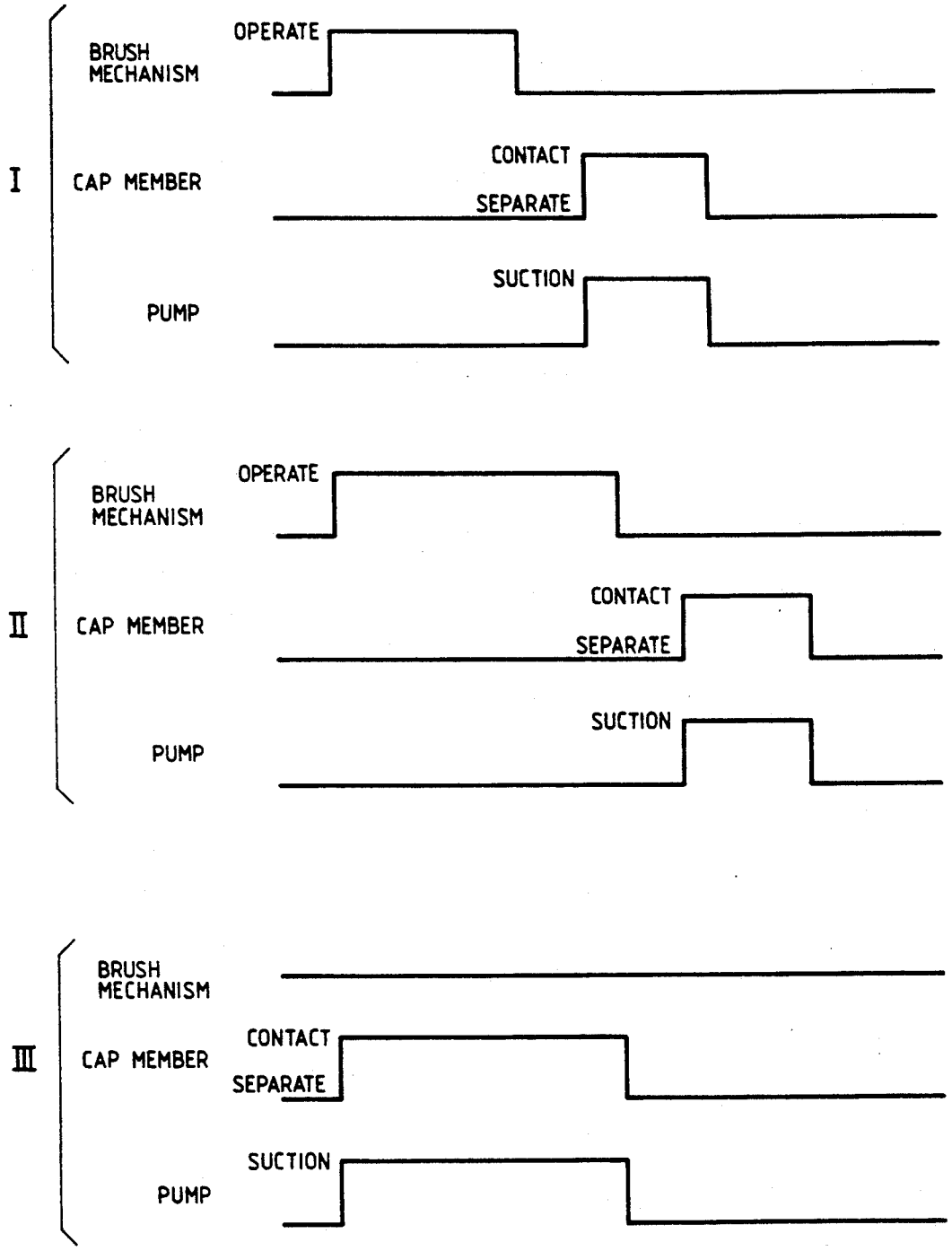

The operation of the apparatus thus arranged will be described with reference to FIGS. 33 and 34 respectively showing a flow chart and a timing chart.

When a printing defect is found, the user pushes the recovery button 27, which is provided on the chassis of the printer (step 350). Then, the carriage 4 is moved toward the cap member 10 under control of a carriage control circuit (not shown). The carriage 4 faces the cap member 10. At this time, the position detector 18 produces a signal (step 351). In response to the signal, the microcomputer 151 stores time data $t_1$ from the clock circuit 152 in the memory 153, and the microcomputer 151 computes a time difference between time $t_1$ and time $t_0$ of the previous pushing of the button 27 as stored in the memory 153, viz., $\Delta T = t_1 - t_0$ step 352). When the computed time data is compared with the reference time data $T_O$ and the former is smaller than the latter (step 353), the microcomputer 151 computes a time difference between time $t_1$ and time $t_0$ of the previous pushing of the button 27 as stored in the memory 153, viz., $\Delta T = t_1 - t_0$ (step 352). When the computed time data is compared with the reference time data $T_O$ and the former is smaller than the latter (step 353), the microcomputer 151 moves the print head toward the brush 140, which is located separated by a fixed distance from the position detector 18, and places it to face the brush mechanism 140 (step 354). Then, it sends a signal to the wiper drive circuit 146 to operate the brush mechanism 140 (step 355). As a result, the belt 143 is driven by the drive mechanism (not shown), so that the brushes 144 and 144 move in contact with the nozzle openings of the print head 1 to wipe away paper particles and dust at the nozzle openings. After a preset time $T_b$ (the duration of the first brushing operation in this case) (step 356), elapses (step 357), the brush mechanism 140 is stopped (step 358). Then, the computer 151 issues a signal to the solenoid drive circuit 28, and energizes the solenoid 12 to hermetically close the nozzle face 1a of the print head 1 with the cap member 10 (step 359). The microcomputer 151 sends a signal to the pump drive circuit 29 to operate the suction pump 20. As a consequence, the negative pressure acts on the nozzle face 1a to extract ink through the nozzle openings. With the flow of the ink, paper particles and dust adhered to the nozzle openings are washed away. At the same time, the meniscus near the nozzle openings is recovered from its destruction caused by the brushing operation. When time $T_S$, which is the time taken until the pump has sucked an amount of ink necessary for removing the foreign material, elapses or for the recovery of the meniscus, the microcomputer 151 stops the operation of the pump 20 (step 360), and at the same time de-energizes the solenoid 12 to separate the cap member 10 from the print head (step 361). Under this condition, the print head 1 is operated in a print region and starts the printing operation again (FIG. 34, waveforms I).

A printing defect occurs again after a relatively short time of ten and several minutes to one hour from the previous pushing of the button 27. After recognizing the printing defect, the user pushes the button 27 again (step 350). Then, the carriage 4 is moved and reaches the position of the cap member 10, and the position detector 18 produces a signal (step 351). At this time, the microcomputer 151 stores time data $l_2$ from the clock circuit 152 in the memory 153, and computes a time difference between time $t_1$ of the previous ink suction as stored in the memory 153, and time $t_2$ of the present ink suction, viz., $\Delta T = t_2 - t_1$ (step 352). Then, it compares the difference time with the reference time $T_O$. The result of the comparison shows that the reference time $T_O$ is shorter than the difference time (step 353). The microcomputer 151 sends a signal to the solenoid drive circuit 28 to press the cap member 10 against the nozzle front faces of the print head 1 (step 362). Then, it operates the pump 20 to apply a negative pressure into the nozzle receiving chamber 17 of the cap member 10 (step 363). The negative pressure acts on the nozzle front face 1a, and extracts jet from the ink flow path through the nozzle openings. Together with the discharge of the ink, the bubbles contained in the ink flow path is discharged through the nozzle openings to exterior. After the pump 20 is operated from the time $T_L$ necessary for taking out the ink of the quantity $Q_2$ for the bubble removal (step 363), the solenoid 12 is de-energized to remove the cap member 10 from the nozzle openings, and the carriage 4 is placed to be movable to the print region (step 361). Five to ten hours elapse from time point t where the recovery button 27 is pushed. At this time, the microcomputer 351 executes the process from the step 350 to step 361 to remove the foreign material and to recover the printer from its abnormal state.

After the recovery of the printer, time $T_O'$ elapses, which is longer than the reference time $T_O$, but is very close to the reference time $T_O$. At this time, the button 27 is pushed again (step 350). Then, the cap member 10 moves to and faces the print head 1, and the position detector 18 produces a signal (step 351). At this time, the microcomputer 151 stores the time data $t_3$ of the clock circuit 152 in the memory 153, and computes a difference between time $t_3$ of the present pushing of the button 27 and the time data $t_2$ of the previous pushing stored in the memory 153, viz., $\Delta T = t_3 - t_2$ (step 352). The comparison result shows that the reference time $T_O$ is shorter than the time difference computed (step 353). The microcomputer 151 moves the print head 1 toward the brush mechanism 140, which is located separated by a fixed distance from the position detector 18, and places it to face the brush mechanism 140 (step 354). Then, the microcomputer 151 sends a signal to the wiper drive circuit 146 to operate the brush mechanism 140 (step 355). As a result, the belt 143 is driven by the drive mechanism (not shown), so that the brushes 144 and 144 move in contact with the nozzle openings of the print head 1, to wipe away paper particles and dust at the nozzle openings. In the case now discussed, the time interval between the pushings of the button 27 is very close to the reference time $T_O$ (step 356). Therefore, probably paper particles and dust, and paper pieces resulting from jamming, for example, are still left on the nozzle openings. To cope with this, the original brushing time $T_b$ is incremented by $\Delta T_b$ into time $T_d = T_b + \Delta T_c$ (step 364). After the time $T_d$ elapses, the brush mechanism 140 is stopped (step 358). Then, the steps 359 to 361 are executed, and the print recovery operation ends. In this way, the paper particles and pieces can be removed completely (FIG. 34, waveforms II). Subsequently, every time the button 27 is pushed at the time intervals approximate to the reference time $T_O$, the brushing time $T_d$ is incremented.

Figure 35:
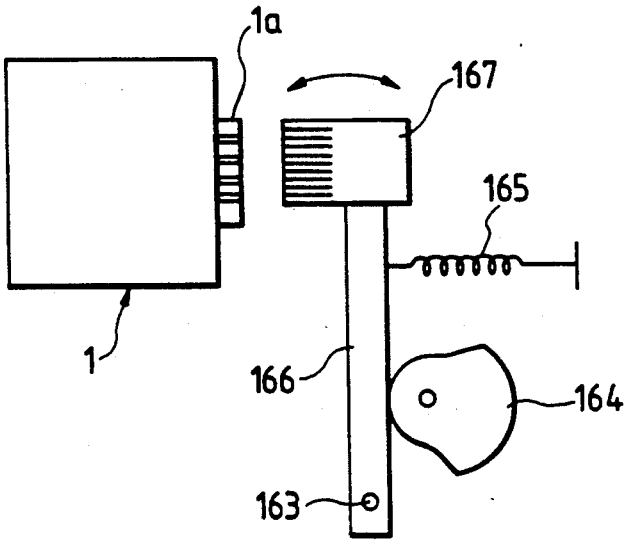
FIG. 35 is a side view showing another embodiment of a brush mechanism.

In the embodiment described above, the brushes are mounted on the belt. The brushes is moved in contact with the nozzle face of the printer head with the rotation of the belt. Alternatively, as shown in FIG. 35, an eccentric cam 164 is coupled with a rotating drive mechanism (not shown). An arm 166, which is swingable about a shaft 163, is held in contact with the eccentric cam 164 by means of a spring 165. A brush 167 is mounted on the free end of the arm 166. In operation, the cam 164 rotates and accordingly the brush 167 reciprocatively contacts the nozzle face 1a of the printer head 1. Also, the brush may be fixed at a position where it is in contact with the nozzle face of the printer head, and under this condition the print head is moved with the reciprocative motion of the carriage.

Figure 36:
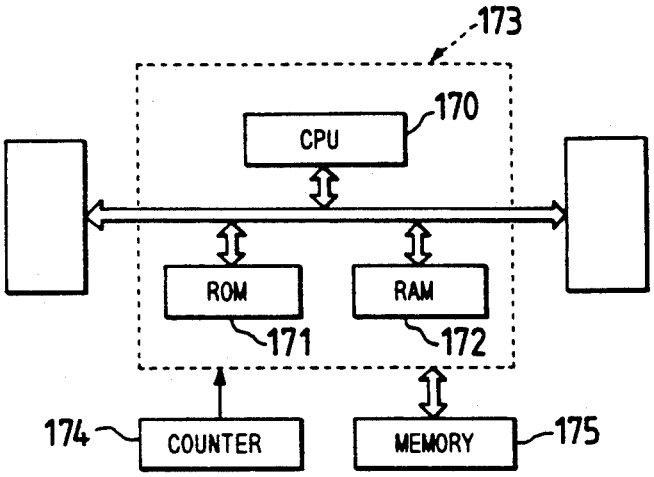
FIG. 36 is a block diagram showing a control circuit constituting a tenth embodiment of the present invention.

FIG. 36 shows a tenth embodiment of the present invention in the form of an arrangement of the control circuit 145. As shown, the control circuit 145 is composed a microcomputer 173 including a CPU 170, a ROM 171 and a RAM 172, a counter 174 for counting a print quantity, such as the number of printed characters, the number of lines, and an amount of paper feed, and a memory 175 for storing data of the counted print quantity derived from the counter 174 when the recovery button 27 is pushed. It is programmed so as to execute a sequence of operations as given below. When the recovery button 27, which is provided on an operating panel of the printer chassis, is pushed, the position detector 18 produces a signal. At this time, the control circuit sends a signal to the solenoid drive circuit 28. In turn, the drive circuit 28 drives the solenoid 12 to press the cap member 10 against the print head 1. Then, it sends a signal to the pump drive circuit 29 to operate the suction pump 20 for a preset time, or it sends a signal to the wiper drive circuit 146 to drive the brush mechanism 140.

Figure 37:
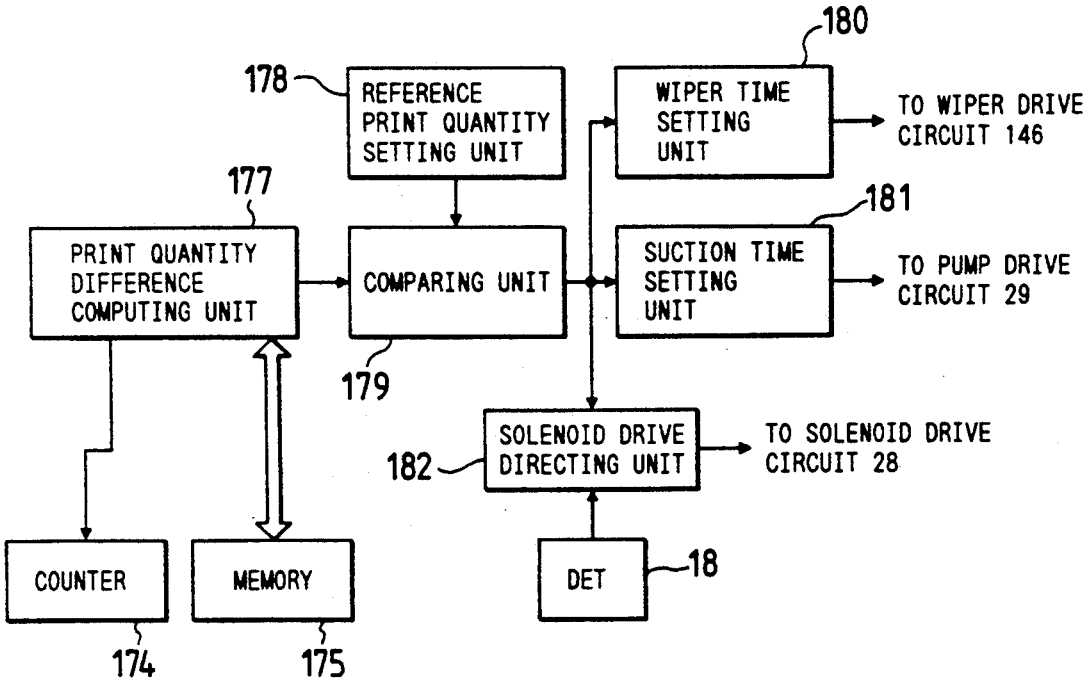
FIG. 37 is a block diagram showing the function to be executed by a microcomputer in the tenth embodiment of the present invention.

FIG. 37 is a functional block diagram showing a model of the function to be realized by the microcomputer 173. The circuit is composed of print quantity difference computing unit 177, reference print quantity setting unit 178, comparing unit 179, wiping time setting unit 180, suction time setting unit 181, and solenoid drive directing unit 182. The print quantity difference computing unit 177 computes a print quantity difference between print quantity data stored in the memory 175 and data output from the counter 174 when the recovery button 27 is pushed. The reference print quantity setting unit 178 stores a reference print quantity $L_O$ to determine the type of printing defect. The comparing unit 179 compares the print quantity difference data from the print quantity difference computing unit 177 with the reference print quantity $L_O$. The wiping time setting unit 180 is for setting a wiping time $T_d$ necessary for removing paper particles and dust, on the basis of the comparison result. The suction time setting unit 181 selects an ink suction time $T_c$ after the wiping or a suction time $T_L$ long enough to remove air bubbles on the basis of the result of the comparison. The solenoid drive directing unit 182 generates a signal that moves the print head 1 toward the brush mechanism 140 of the cap member 10, and that, when the print head 1 is positioned in front of the cap member 10, energizes the solenoid 12 or de-energizes the same when the suction operation is completed.

Figure 38:
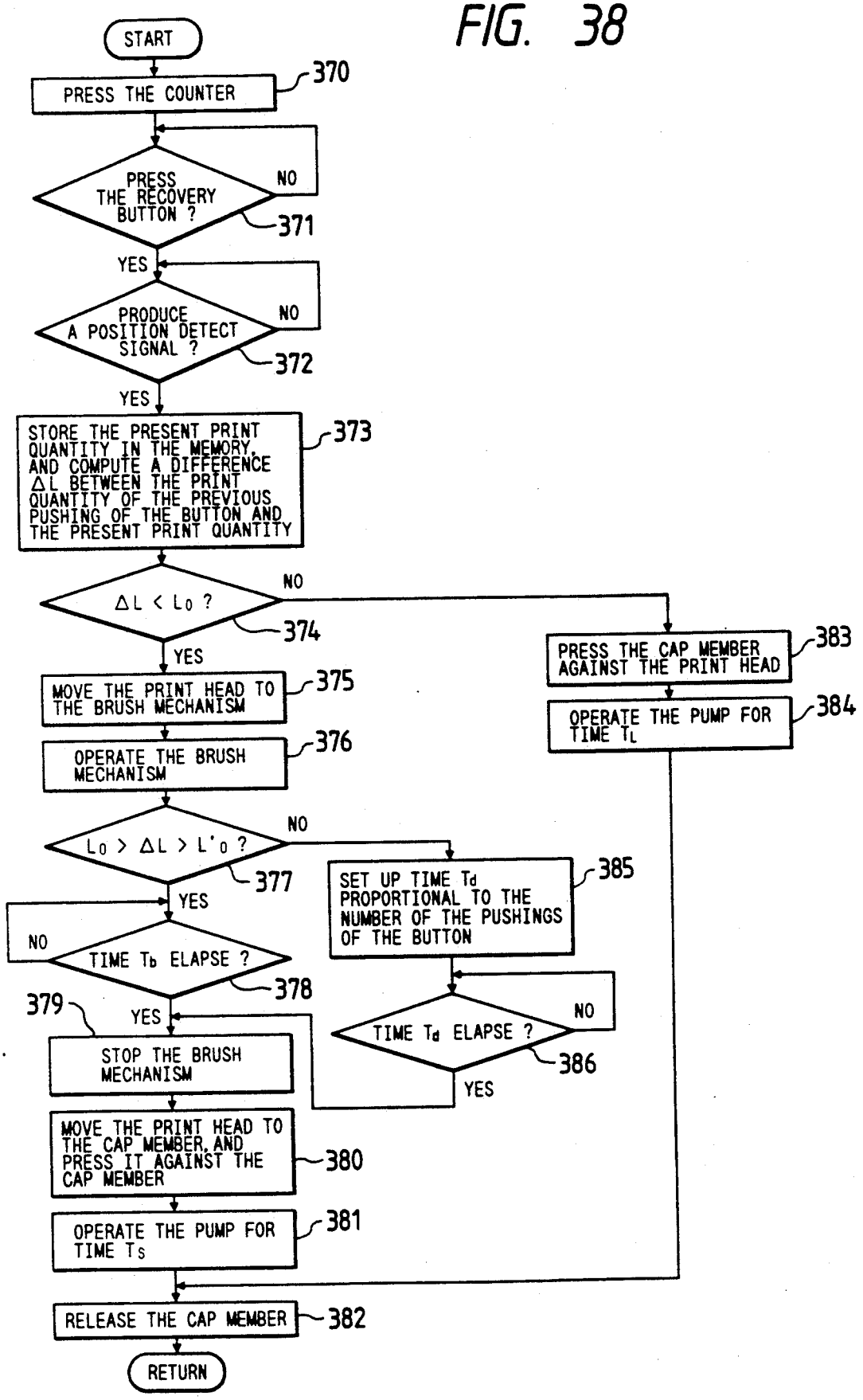
FIG. 38 is a flow chart showing an operation of the tenth embodiment.

The operation of the apparatus thus arranged will be described with reference to FIG. 38 showing a flow chart.

Upon start of a printing operation, the microcomputer 173 causes the counter 174 to count the print quantity (step 370). During the printing operation, if a printing defect is found, the user pushes the recovery button 27 provided on the chassis of the printer (step 371). Then, the carriage 4 is moved toward the cap member 10 under control of a carriage control circuit (not shown). The carriage 4 faces the cap member 10. At this time, the position detector 18 produces a signal (step 372). In response to the signal, the microcomputer 173 fetches from the counter 174 the print quantity $l_1$, and stores it in the memory 175. Then, the microcomputer 173 computes a print quantity difference between the print quantity $l_1$ and a print quantity $l_0$ obtained in the previous pushing of the recovery button 27, viz., ($\Delta L = l_1 - l_0$) (step 373). When the computed time data is compared with the reference time data $T_O$ and the former is smaller than the latter (step 374), the microcomputer 151 moves the print head 1 toward the brush mechanism 140, which is located separated by a fixed distance from the position detector 18, and places it to face the brush mechanism 140 (step 375). Then, it sends a signal to the wiper drive circuit 146, to operate the brush mechanism 140 (step 376). As a result, the belt 143 is driven by the drive mechanism (not shown), so that the brushes 144 and 144 move in contact with the nozzle openings of the print head 1, to wipe away paper particles and dust at the nozzle openings. After a preset time, or time $T_b$ because of the first brushing operation in this case (step 377), elapses (step 378), the brush mechanism 140 is stopped (step 379). Then, the computer 173 moves the print head 1 to the cap member 10, and issues a signal to the solenoid drive circuit 28, and energizes the solenoid 12 to hermetically close the nozzle face 1a of the print head 1 with the cap member 10 (step 380). The microcomputer 151 sends a signal to the pump drive circuit 29 to operate the suction pump 20. As a consequence, the negative pressure acts on the nozzle face 1a to extract ink through the nozzle openings. With the flow of the ink paper particles and dust adhering to the nozzle openings are washed away. At the same time, the meniscus near the nozzle openings is recovered from its destruction caused by the brushing operation. When time $T_S$, which is the time taken until the pump has sucked an amount of ink necessary for removing the foreign material, elapses or for the recovery of the meniscus, the microcomputer 151 stops the operation of the pump 20 (step 381), and at the same time deenergizes the solenoid 12 to separate the cap member 10 from the print head 1 (step 382). Under the condition, the print head 1 is operable in a print region and starts the printing operation again.

A printing defect occurs again after a relatively small print quantity of several tens lines from the previous pushing of the button 27. After recognizing the printing defect, the user pushes the button 27 again (step 371). Then, the carriage 4 is moved and reaches the position of the cap member 10, and the position detector 18 produces a signal (step 372). At this time, the microcomputer 173 stores time data $l_2$ from the counter circuit 174 in the memory 175, and computes a difference between the print quantity $l_2$ and the print quantity $l_1$ of the previous pushing of the button 27, viz., $\Delta L = l_2 - l_1$ (step 373). Then, it compares the difference time with the reference time $T_O$. The result of the comparison shows that the reference time $T_O$ is shorter than the difference time (step 374). The microcomputer 173 sends a signal to the solenoid drive circuit 28 to press the cap member 10 against the nozzle front faces of the print head 1 (step 383). Then, it operates the pump 20 to apply a negative pressure in the nozzle receiving chamber 17 of the cap member 10. The negative pressure acts on the nozzle front face 1*a*, and extracts jet from the ink flow path through the nozzle openings. Together with the discharge of the ink, the bubbles contained in the ink flow path is discharged through the nozzle openings to exterior. After the pump 20 is operated for the time $T_L$ necessary for taking out the ink of the quantity $Q_2$ for the bubble removal (step 384), the solenoid 12 is deenergized to remove the cap member 10 from the nozzle openings, and the carriage 4 is placed to be movable to the print region (step 382).

From the print quantity $l_2$ of the previous pushing of the button 27, the print quantity grows to be in excess of the reference print quantity $L_0$. At this time, the recovery button 27 is pushed. Then, the microcomputer 173 executes the process from the step 371 to step 382, to remove the foreign material and to recover the printer from its abnormal state.

After the recovery of the printer, a print quantity $L_O$ is obtained, which is larger than the reference print quantity $L_O$, but is smaller than the reference print quantity $L_O'$ which is slightly larger than that $L_O$. At this time, the button 27 is pushed again (step 371). Then, the cap member 10 moves to and faces the print head 1, and the position detector 18 produces a signal (step 372). At the time, the microcomputer 173 stores the print quantity data 13 of the counter circuit 174 in the memory 175, and computes a difference between print quantity $l_3$ of the present pushing of the button 27 and the print quantity data $l_2$ of the previous pushing stored in the memory 175, viz., $\Delta T = l_3 - l_2$ (step 373). The comparison result shows that the reference print quantity $L_O$ is shorter than the print quantity difference computed (step 374). The microcomputer 173 moves the print head 1 toward the brush mechanism 140, which is located separated by a fixed distance from the position detector 18, and places it to face the brush mechanism 140 (step 375). Then, it sends a signal to the wiper drive circuit 146, to operate the brush mechanism 140 (step 376). As a result, the belt 143 is driven by the drive mechanism (not shown), so that the brushes 144 and 144 move in contact with the nozzle openings of the print head 1 to wipe away paper particles and dust at the nozzle openings. In the case now discussed, the print quantity interval between the pushings of the button 27 is very close the reference print quantity $L_O$ (step 377). Therefore, probably paper particles and dust, and paper pieces resulting from jamming, for example, are still left on the nozzle openings. To cope with this, the first brushing time $T_b$ after the bubble removal is incremented by $\Delta T_b$ into time $T_d = T_b + \Delta T_c$ (step 385). After the time $T_d$ elapses (step 386), the brush mechanism 140 is stopped (step 379). Then, the steps 380 to 382 are executed, and the print recovery operation ends. In this way, the paper particles and pieces can be removed completely. Subsequently, every time the button 27 is pushed at time intervals approximate the reference print quantity $L_O$, the brushing time $T_d$ is incremented.

In the ninth and tenth embodiments, the microcomputer in the control circuit determines the brushing time of each brushing and the number of brushings on the basis of the time intervals between the pushings of the recovery button 27. Therefore, the printer can be quickly recovered from light printing defects which frequently occur due to paper particles and dust accumulating on the nozzles openings during the printing operation. For heavy printing defects due to paper pieces caused by jamming, the brushing time is extended to reduce the recovery time of the printer and the number of pushings of the recovery button.

While the ink tank and the print head are separated and interconnected by the tube in the embodiments discussed above, it is evident that the present invention is applicable to printers in which the ink tank and the print head are assembled in a single unit, and the unit is mounted on the carriage.

What is claimed is:

1. An ink jet recording apparatus comprising:

an ink jet print head for forming dots on a recording sheet by shooting ink jets from an array of nozzles;

a cap member which, when pressed against a nozzle surface of said print head, forms a hermetically sealed head receiving chamber;

a suction pump for applying a negative pressure to said head receiving chamber, thereby to suck ink through said nozzles;

cap member drive means for placing said cap member in contact with and separating said cap member from said print head;

cap member drive signal generating means for generating a signal to said cap member drive means to place said cap member in contact with said print head;

suction pump drive signal generating means for generating a signal to said suction pump to cause said suction pump to start a suction operation;

a recovery button provided on a printer chassis; and control circuit receiving a signal from said recovery button provided on said printer chassis, said control circuit computing a difference between a print quantity at a present pushing of said recovery button and a print quantity at a previous pushing thereof, and determining a suction time on a basis of said print quantity difference computed, and producing an instruction signal to said cap member drive signal generating means and said suction pump drive signal generating means so as to operate said cap member drive signal generating means and said suction pump drive signal generating means according to the determined suction time.

2. The ink jet recording apparatus according to claim 1, in which said cap member is disposed outside a print region.

3. An ink jet recording apparatus comprising:

an ink jet print head for forming dots on a recording sheet by shooting ink jets from an array of nozzles;

a cap member which, when pressed against a nozzle surface of said print head, forms a hermetically sealed head receiving chamber;

a suction pump for applying a negative pressure to said head receiving chamber, to thereby suck ink through said nozzles;

cap member drive means for placing said cap member in contact with and separating said cap member from said print head;

valve means for communicating with said cap member and the atmosphere;

cap member drive signal generating means for generating a signal to said cap member drive means to place said cap member in contact with said print head;

suction pump drive signal generating means for generating a signal to said suction pump to cause said suction pump to start a suction operation;

valve driving means for driving said valve means;

a recovery button provided on a printer chassis; and control circuit receiving a signal from a recovery button provided on a printer chassis, said control circuit computing a difference between a print quantity at a present pushing of said recovery button and the print quantity at a previous pushing thereof, and determining a suction time on a basis of said print quantity difference computed, and producing an instruction signal to said cap member drive signal generating means and said suction pump drive signal generating means so as to operate said cap member drive signal generating means and said suction pump drive signal generating means according to said suction time determined, and when said suction time is longer than a preset value, said control circuit applying a signal to said valve drive means so as to intermittently open and close said valve means.

4. The ink jet recording apparatus according to claim 3, in which said cap member is disposed outside a print region.

* * * * *